US012111061B2

(12) United States Patent
Johnson

(10) Patent No.: US 12,111,061 B2
(45) Date of Patent: Oct. 8, 2024

(54) OVEN APPLIANCES AND METHODS FOR DISPLAYING PRE-COOKING PROGRESS

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 368 days.

(21) Appl. No.: 17/682,424

(22) Filed: Feb. 28, 2022

(65) Prior Publication Data

US 2023/0272918 A1 Aug. 31, 2023

(51) Int. Cl.
*F24C 7/08* (2006.01)
*F24C 7/04* (2021.01)

(52) U.S. Cl.
CPC ..... *F24C 7/085* (2013.01); *F24C 7/04* (2013.01); *F24C 7/088* (2013.01)

(58) Field of Classification Search
CPC ..... F24C 7/088; F24C 7/04; F24C 7/085
See application file for complete search history.

(56) References Cited

U.S. PATENT DOCUMENTS 3,358,122 A 12/1967 Torrey
4,865,010 A 9/1989 Kett
5,695,668 A 12/1997 Boddy
6,104,005 A 8/2000 Adamski et al.
6,337,468 B1 1/2002 Worthington et al.
6,734,403 B2 5/2004 Baker et al.
6,758,206 B1 7/2004 Barnes
6,777,652 B2 8/2004 Stockley
6,831,255 B1 12/2004 Levi et al.
6,943,321 B2 9/2005 Brekken
6,987,252 B2 1/2006 Goodrich
7,378,617 B1 5/2008 Brockman
8,049,142 B2 11/2011 Blackson
8,269,151 B2 9/2012 Klasmeier et al.
(Continued)

FOREIGN PATENT DOCUMENTS

CN 104767768 A 7/2015
CN 204795645 U 11/2015
(Continued)

*Primary Examiner* — Thien S Tran
(74) *Attorney, Agent, or Firm* — Dority & Manning, P.A.

(57) ABSTRACT

An oven appliance or method may provide for directing a pre-cooking setting of a first heating element and receiving a first-sensor temperature signal from a first temperature sensor. Receiving the first-sensor temperature signal may occur during the pre-cooking setting of the first heating element. The method may also include determining a first progress value based on the first-sensor temperature signal and a first fractional constant. The first fractional constant may be a predetermined proportion of a pre-cooking phase. The method may further include receiving a second-sensor temperature signal from a second temperature sensor and determining a second progress value based on the second-sensor temperature signal and a second fractional constant. The second fractional constant may be a predetermined proportion of the pre-cooking phase. The method may still further include directing display of a progress icon based on the first progress value and the second progress value.

20 Claims, 10 Drawing Sheets

(56) References Cited

U.S. PATENT DOCUMENTS

| | | | |
|---|---|---|---|
| 8,304,695 | B2 | 11/2012 | Bonuso et al. |
| 9,930,897 | B2 | 4/2018 | Blue et al. |
| 9,995,492 | B2 | 6/2018 | Adelmann |
| 10,012,392 | B2 | 7/2018 | Froelicher et al. |
| 10,082,297 | B2 | 9/2018 | Kim |
| 10,314,433 | B1 | 6/2019 | Knight |
| 10,448,457 | B2 | 10/2019 | Armstrong |
| 10,502,430 | B1 | 12/2019 | Alvey |
| 10,520,199 | B2 | 12/2019 | Polster |
| 10,677,472 | B2 | 6/2020 | Johnson et al. |
| 10,753,621 | B2 | 8/2020 | Johnson |
| 10,895,385 | B2 | 1/2021 | Otsuki et al. |
| 2004/0149722 | A1 | 8/2004 | Schnell et al. |
| 2014/0130684 | A1 | 5/2014 | Reese et al. |
| 2014/0360387 | A1 | 12/2014 | Bogdon |
| 2015/0208669 | A1 | 7/2015 | Klock et al. |
| 2016/0040892 | A1 | 2/2016 | Wiseman et al. |
| 2016/0378082 | A1 | 12/2016 | Fisher et al. |
| 2017/0089590 | A1 | 3/2017 | Bruin-Slot et al. |
| 2017/0127700 | A1* | 5/2017 | Armstrong ..... A23L 5/10 |
| 2017/0130968 | A1 | 5/2017 | Nagraj |
| 2018/0003390 | A1 | 1/2018 | Trice et al. |
| 2018/0020680 | A1 | 1/2018 | Froelicher et al. |
| 2018/0159958 | A1 | 6/2018 | Lederer |
| 2019/0327795 | A1 | 10/2019 | Hannah et al. |
| 2020/0166217 | A1 | 5/2020 | Smith et al. |

FOREIGN PATENT DOCUMENTS

| | | | | |
|---|---|---|---|---|
| CN | 111145284 | A * | 5/2020 | ..... A47J 27/004 |
| EP | 0579917 | A2 | 1/1994 | |
| EP | 2251609 | B1 | 8/2017 | |
| JP | H07280281 | A | 10/1995 | |
| JP | 2010112664 | A | 5/2010 | |
| JP | 2013257140 | A * | 12/2013 | |
| JP | 2016217609 | A | 12/2016 | |
| KR | 100821731 | B1 | 4/2008 | |
| WO | WO-2009026887 | A2 * | 3/2009 | ..... F24C 7/08 |

* cited by examiner

OVEN APPLIANCES AND METHODS FOR DISPLAYING PRE-COOKING PROGRESS

FIELD OF THE INVENTION

The present subject matter relates generally to oven appliances, and more particularly to features and methods for displaying the progress of a pre-cooking phase, such as during preheating.

BACKGROUND OF THE INVENTION

Conventional residential and commercial oven appliances generally include a cabinet that includes a cooking chamber for receipt of food items for cooking. Multiple gas or electric heating elements are positioned within the cabinet for heating the cooking chamber to cook food items located therein. The heating elements can include, for example, a bake heating assembly positioned at a bottom of the cooking chamber and a separate broiler heating assembly positioned at a top of the cooking chamber. Typically, food or utensils for cooking are placed on wire racks within the cooking chamber and above the bake heating assembly. A temperature sensor within the cooking chamber is often provided to detect the temperature with the cooking chamber.

Since oven appliances are generally unable to instantly reach the elevated temperatures for cooking, modern oven appliances are configured to execute pre-cooking (e.g., preheating) operations that quickly bring a cooking chamber to a desired elevated temperature for cooking. Some form of countdown or rough indication of progress for these preheating operations is often provided (e.g., at a screen or user interface of the oven appliance) so that a user may predict when a pre-cooking operation will be complete and, thus, when the user may start using the cooking chamber to cook food items at the desired temperature. Many oven appliances use a simple, predetermined countdown, which provides a set amount of time (e.g., corresponding to a given temperature), to roughly estimate when a cooking chamber is likely to have reached the desired temperature. Other appliances have attempted to provide slightly more accuracy by using the temperature sensor to detect the actual temperature within the cooking chamber. The temperature increase, however, is often non-linear, such as may be the case when different parts of the oven are heated at different points in time, making it difficult for the oven appliance or user to accurately assess the remaining time or relative progress for a pre-cooking operation.

Accordingly, it would be advantageous to provide an oven appliance or methods for consistently or accurately assessing the progress of a pre-cooking operation.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a plurality of chamber walls, a first heating element, a first temperature sensor, a second heating element, a second temperature sensor, and a controller. The plurality of chamber walls may be mounted within the cabinet. The plurality of chamber walls may define a cooking chamber and include a back wall, a top wall, a first side wall, a second side wall, and a bottom wall. The first heating element may be mounted within the cooking chamber. The first temperature sensor may be disposed within the cabinet to detect a temperature proximal to the first heating element. The second heating element may be mounted within the cooking chamber and spaced apart from the first heating element. The second temperature sensor may be disposed within the cabinet to detect a temperature proximal to the second heating element. The controller may be in operative communication with the first heating element, the first temperature sensor, the second heating element, and the second temperature sensor. The controller may be configured to initiate a cooking operation. The cooking operation may include directing a pre-cooking setting of the first heating element; receiving a first-sensor temperature signal from the first temperature sensor, receiving the first-sensor temperature signal occurring during the pre-cooking setting of the first heating element; determining a first progress value based on the first-sensor temperature signal and a first fractional constant, the first fractional constant being a predetermined proportion of a pre-cooking phase; receiving a second-sensor temperature signal from the second temperature sensor; determining a second progress value based on the second-sensor temperature signal and a second fractional constant, the second fractional constant being a predetermined proportion of the pre-cooking phase; and directing display of a progress icon based on the first progress value and the second progress value.

In another exemplary aspect of the present disclosure, a method of operating an oven appliance is provided. The method may include directing a pre-cooking setting of a first heating element and receiving a first-sensor temperature signal from a first temperature sensor. Receiving the first-sensor temperature signal may occur during the pre-cooking setting of the first heating element. The method may also include determining a first progress value based on the first-sensor temperature signal and a first fractional constant. The first fractional constant may be a predetermined proportion of a pre-cooking phase. The method may further include receiving a second-sensor temperature signal from a second temperature sensor and determining a second progress value based on the second-sensor temperature signal and a second fractional constant. The second fractional constant may be a predetermined proportion of the pre-cooking phase. The method may still further include directing display of a progress icon based on the first progress value and the second progress value.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
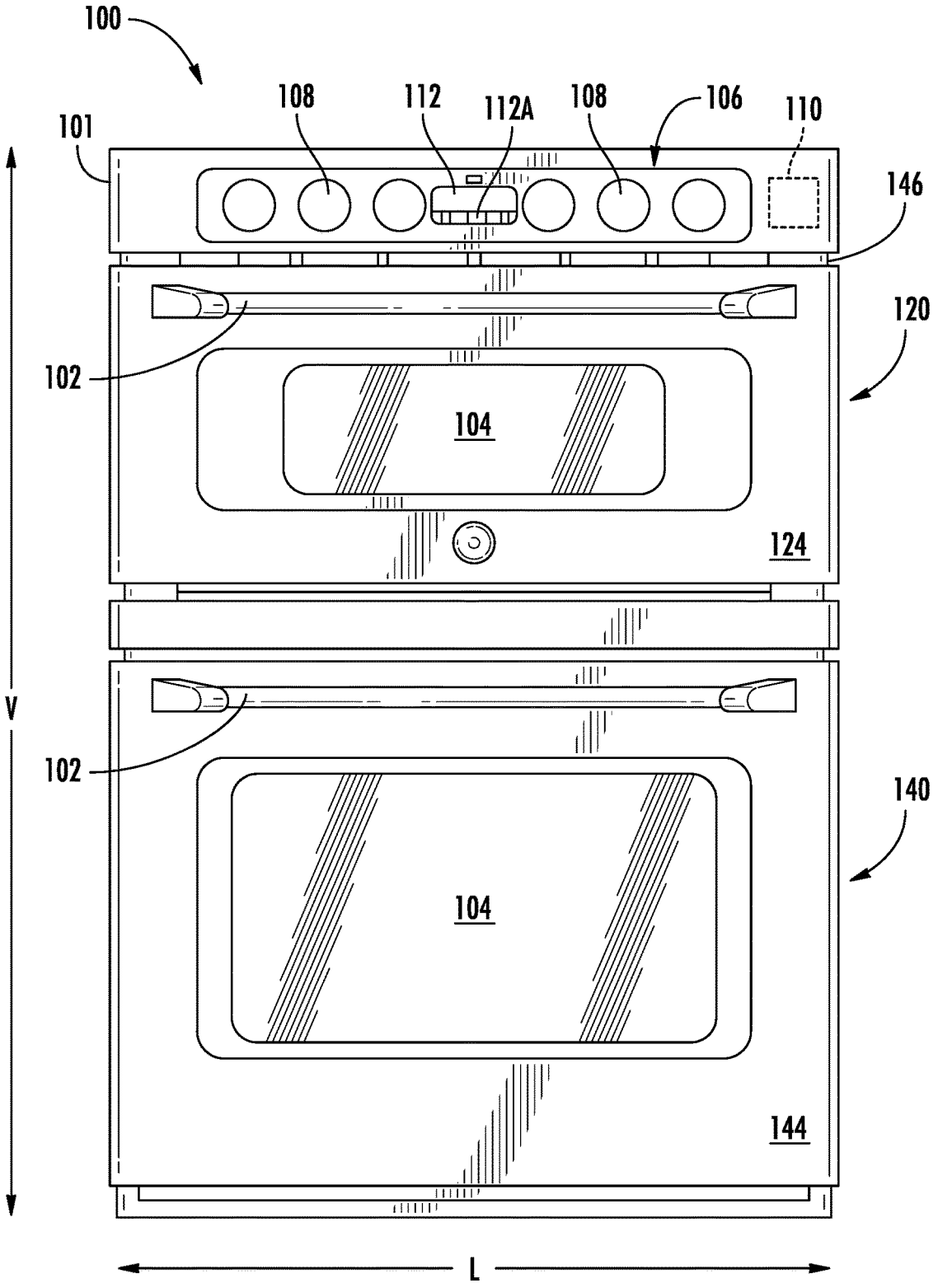
FIG. 1 provides an elevation view of an oven appliance according to exemplary embodiments of the present disclosure.
Figure 2:
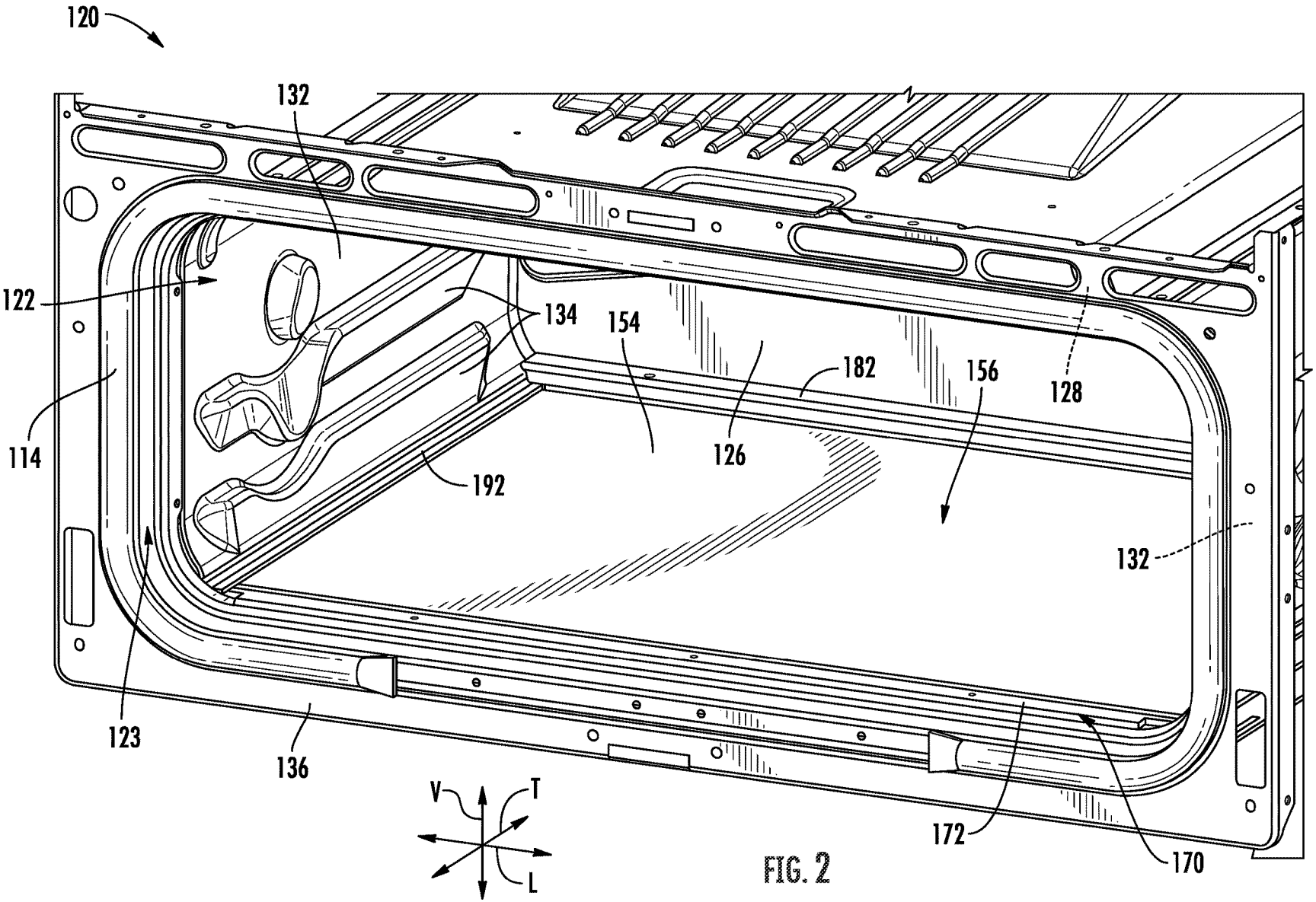
FIG. 2 provides a perspective view of an upper cooking chamber of the exemplary oven appliance of FIG. 1.
Figure 3:
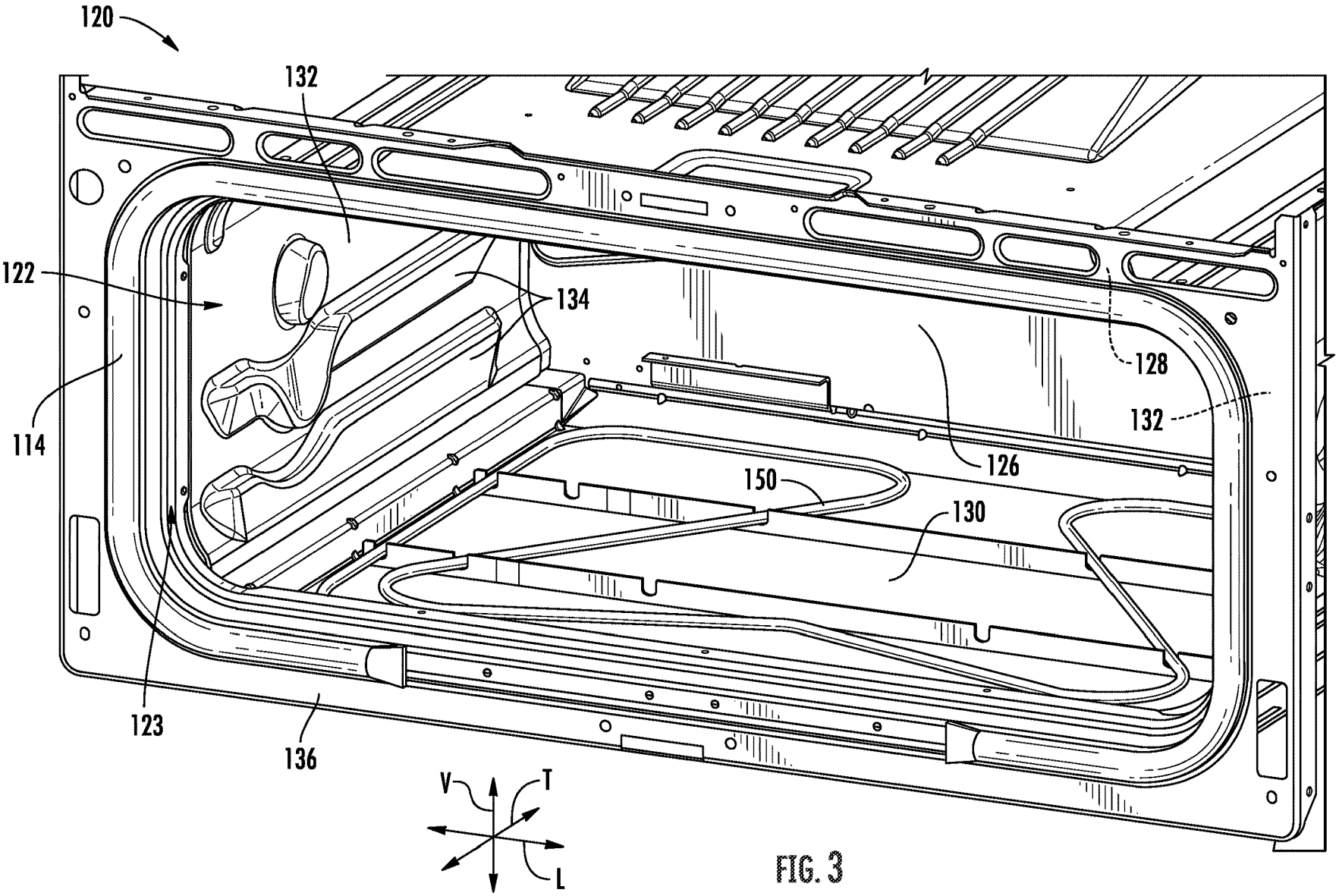
FIG. 3 provides another perspective view of the upper cooking chamber of the exemplary oven appliance of FIG. 1, wherein a cooking plate has been omitted for clarity.
Figure 4:
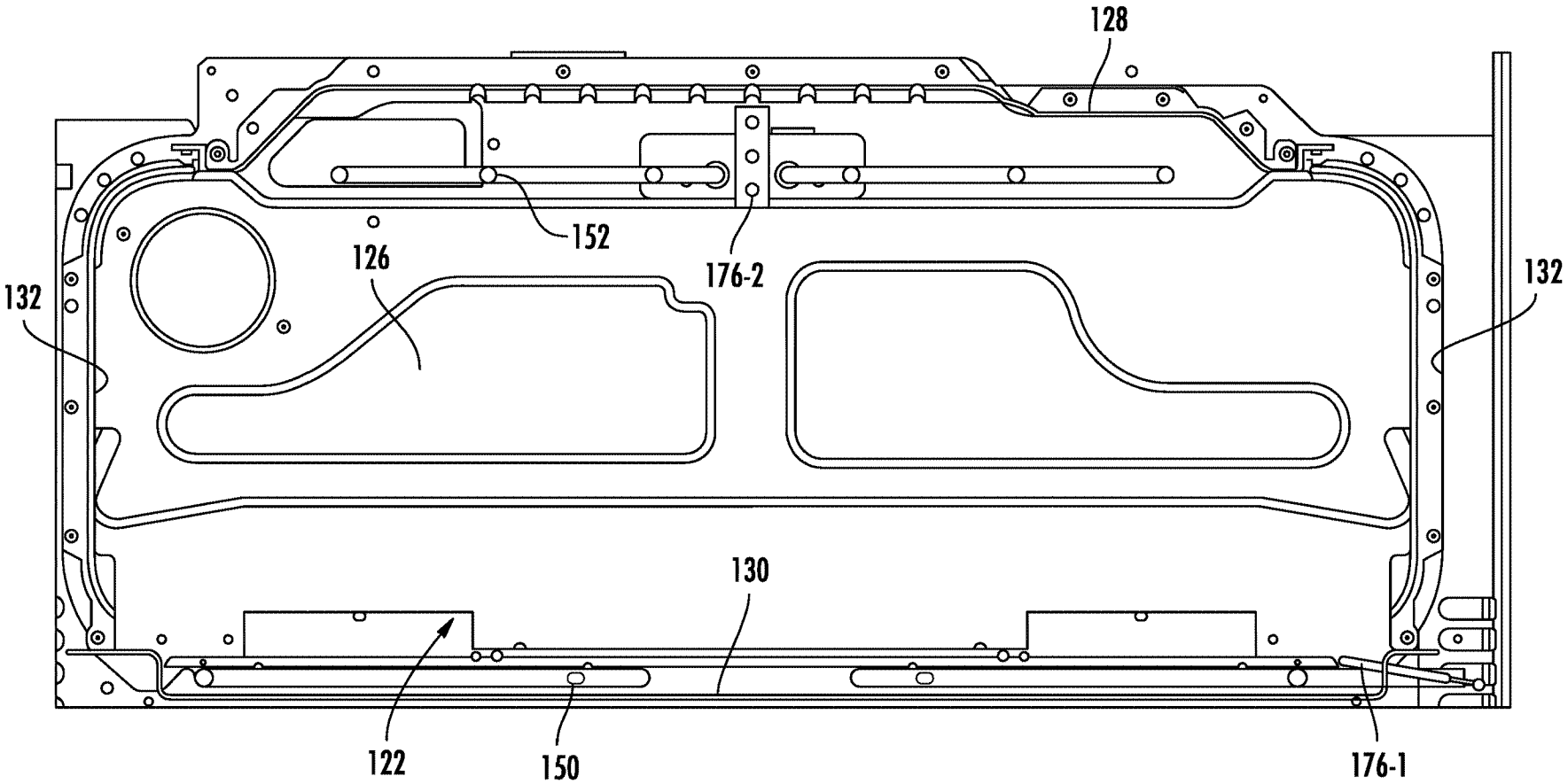
FIG. 4 provides an elevation view of the exemplary upper cooking chamber of FIG. 3.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "coupled," "fixed," "attached to," and the like refer to both direct coupling, fixing, or attaching, as well as indirect coupling, fixing, or attaching through one or more intermediate components or features, unless otherwise specified herein.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value).

Referring now to the drawings, FIG. 1 illustrates an exemplary embodiment of a double oven appliance 100 according to the present disclosure.

Although aspects of the present subject matter are described herein in the context of a double oven appliance 100, it should be appreciated that oven appliance 100 is provided by way of example only. Other oven or range appliances having different configurations, different appearances, or different features may also be utilized with the present subject matter as well (e.g., single ovens, electric cooktop ovens, induction cooktops ovens, etc.).

Generally, oven appliance 100 has a cabinet 101 that defines a vertical direction V, a longitudinal direction L and a transverse direction T. The vertical, longitudinal and transverse directions are mutually perpendicular and form an orthogonal direction system. In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 101 does not necessarily require an enclosure and may simply include open structure supporting various elements of appliance 100. By contrast, cabinet 101 may enclose some or all portions of an interior of cabinet 101. It should be appreciated that cabinet 101 may have any suitable size, shape, and configuration while remaining within the scope of the present subject matter.

Double oven appliance 100 includes an upper oven 120 and a lower oven 140 positioned below upper oven 120 along the vertical direction V. Upper and lower ovens 120 and 140 include oven or cooking chambers 122 and 142, respectively, configured for the receipt of one or more food items to be cooked. Specifically, cabinet 101 defines a respective opening for each cooking chamber 122 and 142. For instance, an upper opening 123 may be defined (e.g., along the transverse direction T) to access upper cooking chamber 122.

Double oven appliance 100 includes an upper door 124 and a lower door 144 in order to permit selective access to cooking chambers 122 and 142, respectively (e.g., via the corresponding opening). Handles 102 are mounted to upper and lower doors 124 and 144 to assist a user with opening and closing doors 124 and 144 in order to access cooking chambers 122 and 142. As an example, a user can pull on handle 102 mounted to upper door 124 to open or close upper door 124 and access cooking chamber 122. Glass window panes 104 provide for viewing the contents of cooking chambers 122 and 142 when doors 124, 144 are closed and also assist with insulating cooking chambers 122 and 142. Optionally, a seal or gasket (e.g., gasket 114) extends between each door 124, 144 and cabinet 101 (e.g., when the corresponding door 124 or 144 is in the closed position). Such gasket may assist with maintaining heat and cooking fumes within the corresponding cooking chamber 122 or 142 when the door 124 or 144 is in the closed position. Moreover, heating elements, such as electric resistance heating elements, gas burners, microwave elements, etc., are positioned within upper and lower oven 120 and 140.

A control panel 106 of double oven appliance 100 provides selections for user manipulation of the operation of double oven appliance 100. For example, a user can touch control panel 106 to trigger one of user inputs 108. In response to user manipulation of user inputs 108, various components of the double oven appliance 100 can be operated.

Control panel 106 may also include a display 112, such as a digital display, operable to display various parameters (e.g., temperature, time, current phase or cycle, etc.) of the double oven appliance 100. For instance, display 112 may include a portion (or be configured to present) a progress icon 112A that can be manipulated (e.g., illuminated or directed to change color incrementally), such as to illustrate the relative duration of selected phase or cycle. As an example, and as will be described in greater detail below, the sub-portion or proportion of progress icon 112A that is illuminated may be contingent on the amount of predicted time that remains in a given phase or cycle (e.g., preheating or recharge). Thus, the illuminated portion of progress icon 112A may increase (or alternatively decrease) as the corresponding phase or cycle elapses. Moreover, illumination increase or decrease may be configured to be roughly linear with respect to time. In turn, a half-illuminated presentation of progress icon 112A may correspond with a moment in time when the corresponding phase or cycle is halfway completed.

It is noted that although progress icon 112A is illustrated in FIG. 1 as a linear bar having seven discrete, illuminating regions (e.g., to be sequentially illuminated), any other suitable shape or outlay for presenting relative fractions of elapsed time (e.g., a changing pie shape, dial, percentage numerals, etc.) may be provided, as would be understood.

Figure 5:
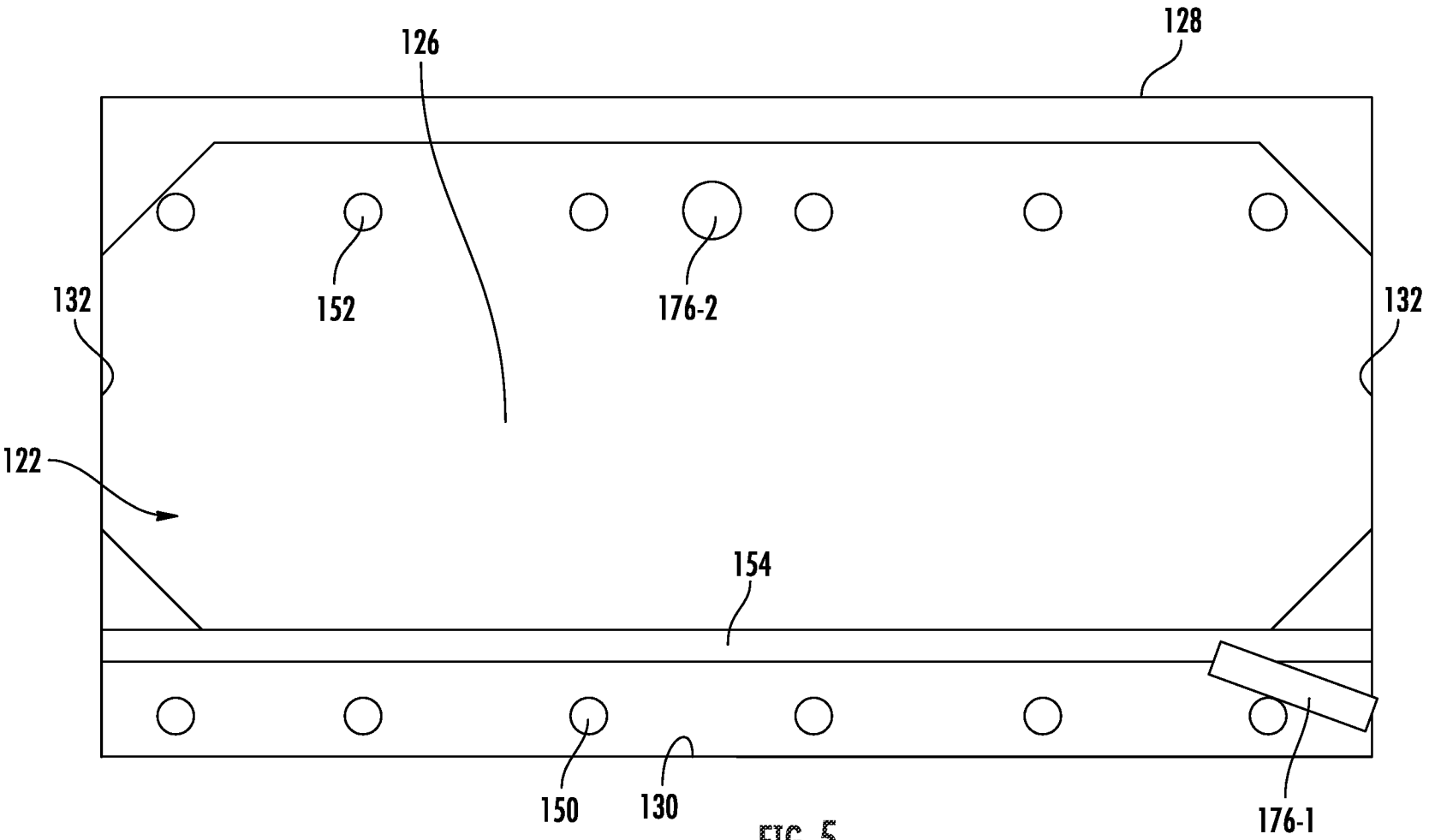
FIG. 5 provides a schematic elevation view of the upper cooking chamber of the exemplary oven appliance of FIG. 1.

Generally, oven appliance 100 may include a controller 110 in operative communication (e.g., operably coupled via a wired or wireless channel) with control panel 106. Control panel 106 of oven appliance 100 may be in communication with controller 110 via, for example, one or more signal lines or shared communication busses, and signals generated in controller 110 operate oven appliance 100 in response to user input via user input devices 108. Input/Output ("1/O") signals may be routed between controller 110 and various operational components of oven appliance 100 such that operation of oven appliance 100 can be regulated by controller 110. In addition, controller 110 may also be in communication with one or more sensors, such as a first temperature sensor (TS1) 176-1 (e.g., bottom temperature sensor) or a second temperature sensor (TS2) 176-2 (e.g., oven temperature sensor) (FIG. 5). Generally, either or both TS1 176-1 and TS2 176-2 may include or be provided as a thermistor or thermocouple, which may be used to measure temperature at a location proximate to upper cooking chamber 122 and provide such measurements to the controller 110. Although TS1 176-1 is illustrated as a probe extending proximate to or above bottom heating element 150 (e.g., to or below a cooking plate 154) and TS2 176-2 is illustrated proximate to or below top heating element 152 (e.g., above ribs 134 or cooking plate 154), it should be appreciated that other sensor types, positions, and configurations may be used according to alternative embodiments.

Controller 110 is a "processing device" or "controller" and may be embodied as described herein. Controller 110 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 110 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Turning now to FIGS. 2 through 5, various views are provided illustrating, in particular, upper cooking chamber 122 of upper oven 120. As shown, upper cooking chamber 122 is generally defined by a back wall 126, a top wall 128 and a bottom wall 130 spaced from top wall 128 along the vertical direction V by opposing side walls 132 (e.g., a first wall and a second wall). Optionally, a front plate 136 may be attached to the walls to define the upper opening 123. For instance, front plate 136 may extend along bottom wall 130, top wall 128, and the opposing side walls 132 about upper opening 123. In turn, gasket 114 may be mounted on or engaged with front plate 136 (e.g., when the corresponding upper door is closed). In some embodiments opposing side walls 132 include embossed ribs 134 such that a baking rack containing food items may be slidably received onto embossed ribs 134 and may be moved into and out of upper cooking chamber 122 when door 124 is open. Optionally, such walls 126, 128, 130, 132 may be included within an outer casing 146 of cabinet 101, as is understood.

As shown, upper oven includes one or more heating elements to heat upper cooking chamber 122 (e.g., as directed by controller 110 as part of a cooking operation). For instance, a bottom heating element 150 may be mounted at a bottom portion of upper cooking chamber 122 (e.g., above bottom wall 130). Additionally or alternatively, a top heating element 152 may be mounted at a top portion of upper cooking chamber 122 (e.g., below top wall 128). Bottom heating element 150 and top heating element 152 may be used independently or simultaneously to heat upper cooking chamber 122, perform a baking or broil operation, perform a cleaning cycle, etc.

The heating elements 150, 152 may be provided as any suitable heater for generating heat within upper cooking chamber 122. For instance, either heating element may include an electric heating element (e.g., resistance wire elements, radiant heating element, electric tubular heater or CALROD®, halogen heating element, etc.). Additionally or alternatively, either heating element may include a gas burner.

In optional embodiments, a cooking plate 154 is provided within upper cooking chamber 122. Specifically, cooking plate 154 is disposed above bottom heating element 150 and may generally cover the same. Along with being disposed above bottom heating element 150, cooking plate 154 is disposed below top heating element 152 and may be disposed below (e.g., at a lower vertical height than) each of the embossed ribs. In certain embodiments, cooking plate 154 is located at or near the same vertical height as the bottommost edge of upper opening 123. Thus, cooking plate 154 may generally be disposed proximal to the lower end of the cooking chamber 122.

When mounted within cooking chamber 122, cooking plate 154 may extend along the transverse direction T between a front end and a rear end, along the lateral direction L between a first lateral end and a second lateral end, and along the vertical direction V between an upper cooking surface 156 and a lower surface. The cooking surface 156, in particular, may be disposed between the bottom wall 130 and the top wall 128. Moreover, cooking surface 156 may be proximal to the bottom wall 130 and, thus, distal to the top wall 128. In some embodiments, cooking plate 154 is provided as a solid nonpermeable member. Thus, food or fluids may be prevented from passing through cooking plate 154 (e.g., along the vertical direction V or perpendicular to cooking surface 156). In certain embodiments, cooking plate 154 includes or is formed from a conductive metal material, such as cast iron, steel, or aluminum (e.g., including alloys thereof). In additional or alternative embodiments, cooking plate 154 includes or is formed from a heat-retaining material, such as clay, stone (e.g., cordierite), ceramic, cast iron, or ceramic-coated carbon steel.

As shown, the cooking plate 154 may be disposed directly above (e.g., in vertical alignment with) the bottom heating element 150. Moreover, cooking plate 154 may define a horizontal footprint that spans across horizontal footprint of bottom heating element 150. In turn, cooking plate 154 may fully cover bottom heating element 150. When mounted within cooking chamber 122, cooking plate 154 may block or otherwise prevent access to bottom heating element 150, such as by a user reaching into the cooking chamber 122. Additionally or alternatively, the bottom heating element 150 may be held out of view such that a user is unable to see the bottom heating element 150. During use, heat generated at bottom heating element 150 may be directed upward to a lower surface of cooking plate 154. As noted, bottom heating element 150 may be vertically aligned with (e.g., directly beneath) the cooking plate 154. The heat generated at bottom heating element 150 may thus be guided primarily or initially to the underside of cooking plate 154.

One or more temperature sensors (e.g., TS1 176-1) may be provided proximal to the bottom wall 130 (i.e., distal to top wall 128) in or otherwise within thermal communication with cooking chamber 122, for instance, to detect the temperature of bottom heating element 150 or cooking plate 154. Optionally, TS1 176-1 may be mounted or held between the bottom heating element 150 and the cooking plate 154. In some embodiments, a TS1 176-1 is disposed against (e.g., a bottom surface of) cooking plate 154. As an example, TS1 176-1 may be disposed on a bottom surface of cooking plate 154 (e.g., when cooking plate 154 is mounted within cooking chamber 122). As an additional or alternative example, TS1 176-1 may be held within a recess in cooking plate 154. As an additional or alternative example, TS1 176-1 may be embedded within cooking plate 154.

Additionally or alternatively, one or more temperature sensors (e.g., TS2 176-2) may be provided proximal to the top wall 128 (i.e., distal to bottom wall 130) in or otherwise within thermal communication with cooking chamber 122, for instance, to detect the temperature of top heating element 152 or cooking chamber 122, generally. Optionally, TS2 176-2 may be mounted between the top wall 128 and the cooking plate 154 (e.g., above TS1 176-1). In some embodiments, TS2 176-2 is mounted at or below heating element 152. Specifically, TS2 176-2 may be laterally positioned between the side walls 132 (e.g., at substantially the lateral middle of cooking chamber 122). As an example, TS2 176-2 may be connected to or otherwise supported on back wall 126 (e.g., via a mechanical fastener, clip, or hook).

When assembled, the temperature sensor(s) 176-1, 176-2 may be operably coupled to controller 110. Moreover, the controller 110 may be configured to control top heating element 152 or bottom heating element 150 based on one or more temperatures detected at the temperature sensor(s) 176-1, 176-2 (e.g., as part of a cooking operation). In some embodiments, a cooking operation initiated by the controller 110 may thus include detecting one or more temperatures of TS1 176-1 and TS2 176-2, and directing heat output from (e.g., a heat setting of) top heating element 152 or bottom heating element 150 based on the detected temperature(s).

Figure 6:
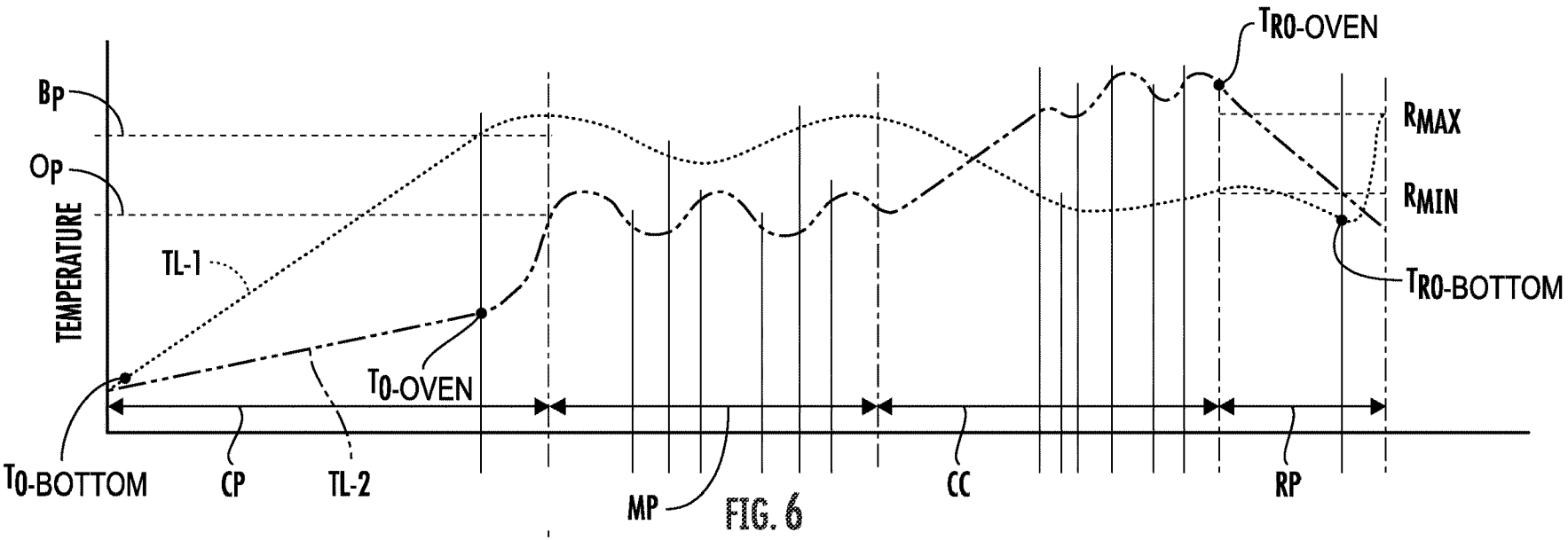
FIG. 6 is a graph view illustrating a temperature over time for two discrete temperature sensors within an oven appliance during a cooking operation according to exemplary embodiments of the present disclosure.
Figure 7:
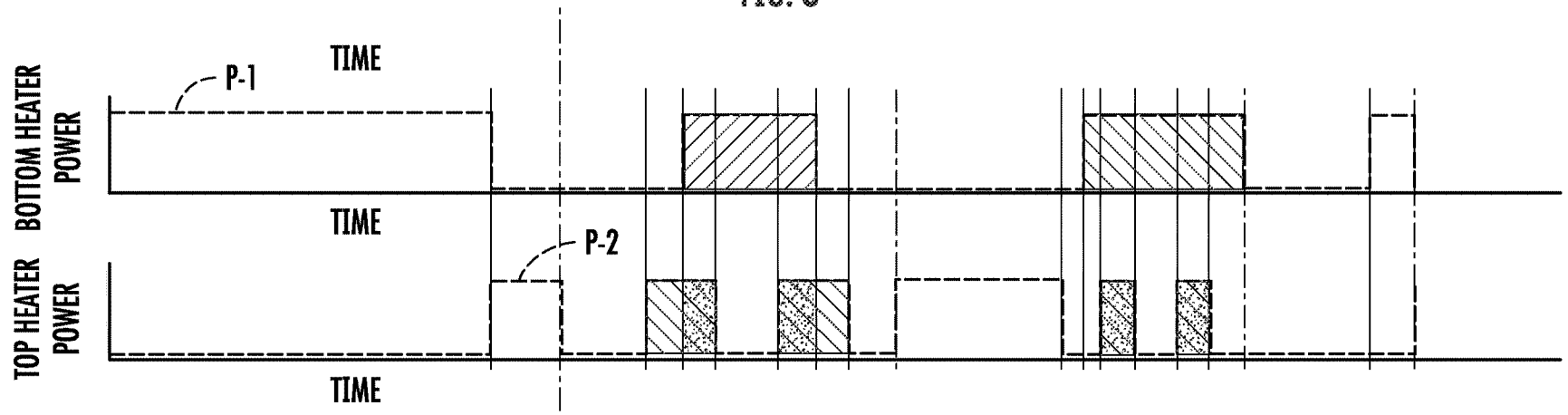
FIG. 7 is a graph view illustrating power output over time for two discrete heaters within an oven appliance during the exemplary cooking operation of FIG. 6.

As an example, and turning briefly to FIGS. 6 and 7, graphs are provided to illustrate a cooking operation directed by controller 110 (FIG. 1) in operative communication with the heating elements 150, 152 (FIG. 5) and temperature sensors 176-1, 176-2 (FIG. 5). In particular, FIG. 6 provides a graph of temperature lines TL-1, TL-2 detected at TS1 176-1 and TS2 176-2, respectively. FIG. 7 provides a graph of output line P-1, P-2 for power output (e.g., as dictated by a duty cycle) at bottom heating element 150 and top heating element 152, respectively. Although the illustrated power output lines P-1, P-2 illustrate the binary active-inactive states of a duty cycle, substitution may be made of a duty cycle for a TRIAC-regulated power cycle wherein power output is directed as a percentage of maximum power output, as would be understood.

As shown, the cooking operation may include an initial pre-cooking (e.g., preheat) phase CP in which the top heater output P-2 and the bottom heater output P-1 are directed according to a preheating cycle. In the preheating cycle, one duty cycle or heat output (e.g., top heat output setting) may be set for the top heating element and another duty cycle or heat output (e.g., bottom heat output) may be set for the bottom heating element. Thus, top heater output P-2 during the preheat phase CP may correspond to the top heat output setting for the preheating cycle while the bottom heater output P-1 during the preheat phase CP may correspond to the bottom heat output setting for the preheating cycle.

As an example, in the preheating cycle, the bottom heater output P-1 may be initially directed to at a relatively high bottom output setting (e.g., between 80% and 100%) while the top heater output P-2 is restricted (e.g., at 0%). As shown, temperature (e.g., as measured along TL-1 and TL-2) increases within the oven chamber until one or more pre-cooking (e.g., preheating) thresholds are met. In the illustrated embodiment, the preheating cycle may continue at the bottom heat output setting until a bottom sensor preheat threshold Bp is met or exceeded (e.g., at TL-1). Subsequently (e.g., in response to Bp being met or exceed), the preheat cycle may direct the bottom heater output P-1 to a restricted (e.g., relatively low or inactive state) while the top heater output P-2 is directed to a relatively high top output setting (e.g., between 80% and 100%). The preheating cycle may then continue at the top heat output setting until a top sensor preheat threshold Op is met or exceeded (e.g., at TL-2). The preheating cycle and phase CP may end or be halted in response to the top sensor preheat threshold Op being met or exceeded. Notably, the cooking plate 166 or surface 168 within the cooking chamber 122 may be brought to a relatively high temperature without reaching excessive or undesirable temperatures within the rest of cooking chamber 122.

As will be described in greater detail, progress of the preheating cycle or phase CP may advantageously be calculated and displayed (e.g., at a progress icon 112A of display 112) to indicate the relative amount of time until the preheating cycle or phase CP is complete such that a user may easily understand how long it will be until the preheat threshold(s) is/are reached.

Following the preheat cycle or phase CP (e.g., immediately thereafter), a new phase with one or more additional cycles, such as a cooking cycle or a maintenance/standby cycle may be executed. In the illustrated embodiments, a maintenance or standby cycle is provided as part of a maintenance phase MP. As shown, in the maintenance phase MP, bottom heating element 150 or top heating element 152 are generally directed to maintain the cooking surface temperature and oven temperatures, for example within a range of temperatures (e.g., a set range relative to Bp or Op). In one embodiment, the maintenance cycle of the maintenance phase MP is characterized by operation of both the bottom heating element 150 and top heating element 152. Operation of bottom heating element 150 and top heating element 152 may occur sequentially or simultaneously.

Following the preheat phase CP or maintenance phase MP, a cooking phase CC may be initiated to execute one or more cooking cycles. Generally, such cooking cycles direct the bottom heating element 150 or top heating element 152 according to a predetermined scheme or sequence. For instance, bottom heating element 150 or top heating element 152 may be directed to one or more corresponding cooking thresholds (e.g., detected at TS1 and TS2, respectively) or for set intervals of time. Exemplary cooking cycles may generally be understood and need not be described in greater detail herein.

In some embodiments, a recharge phase RP including a recharge cycle is initiated following the cooking phase CC (e.g., immediately thereafter or following an intermediate period immediately following the cooking phase CC). Generally, the recharge phase RP may be understood as another pre-cooking phase (e.g., in which the cooking chamber is prepared for cooking additional or successive food items in a subsequent cooking cycle). As an example, the recharge phase RP may include a recharge cycle directing one or both of the heating elements 150, 152 to an inactive state (e.g., for a set recharge time period of no heat time). After being directed to the inactive state (e.g., following expiration of the set recharge timer measuring a portion the recharge no heat time), the bottom heating element 150 may be activated and directed to a relatively high bottom output setting (e.g., between 80% and 100%) while the top heater output P-2 is restricted (e.g., at 0%). Optionally, activation of the bottom heating element is conditioned (e.g., separate from or in addition to the set recharge timer) on temperature at the oven temperature sensor TS2 being less than a recharge minimum threshold (Rmin). Upon being activated, the bottom heating element may continue at the bottom output setting, for instance, until a recharge maximum threshold (Rmax) is measured (e.g., at the bottom temperature sensor TS1). Notably, in practice, the duration of the recharge phase RP may be less than the duration of the preheat cycle CP. Advantageously, excessive heat may be prevented from accumulating within the cooking chamber 122, generally, while maintaining the cooking plate 166 or surface 168 at a relatively high temperature (e.g., for cooking additional or successive food items).

As will be described in greater detail, progress of the recharge cycle or phase RP may advantageously be calculated and displayed (e.g., at a progress icon 112A of display 112) to indicate the relative amount of time until the recharge cycle or phase RP is complete such that a user may easily understand how much long it will be until the recharge threshold(s) is/are reached.

Following the recharge phase RP, one or more additional maintenance or cooking phases may be initiated, as would be understood in light of the present disclosure.

Referring now to FIGS. 8 through 11, the present disclosure may further be directed to methods (e.g., method 800, 900, 1000, or 1100) of operating an oven appliance, such as appliance 100. In exemplary embodiments, the controller 110 may be operable to perform various steps of a method in accordance with the present disclosure.

The methods (e.g., 800, 900, 1000, or 1100) may occur as, or as part of, a cooking operation (e.g., short-cycle cooking operation) of oven appliance 100. In particular, the methods (e.g., 800, 900, 1000, or 1100) disclosed herein may advantageously facilitate the accurate display of a progress icon (e.g., 112A), which may in turn provide a user with an easily understood and accurate representation of the amount of time required for a pre-cooking (e.g., preheating or recharge) phase to be completed.

It is noted that the order of steps within methods 800, 900, 1000, and 1100 are for illustrative purposes. Moreover, none of the methods 800, 900, 1000, and 1100 are mutually exclusive. In other words, methods within the present disclosure may include one or more of methods 800, 900, 1000, and 1100. All may be adopted or characterized as being fulfilled in a common operation. Except as otherwise indicated, one or more steps in the below method 800, 900, 1000, or 1100 may be changed, rearranged, performed in a different order, or otherwise modified without deviating from the scope of the present disclosure.

Figure 8:
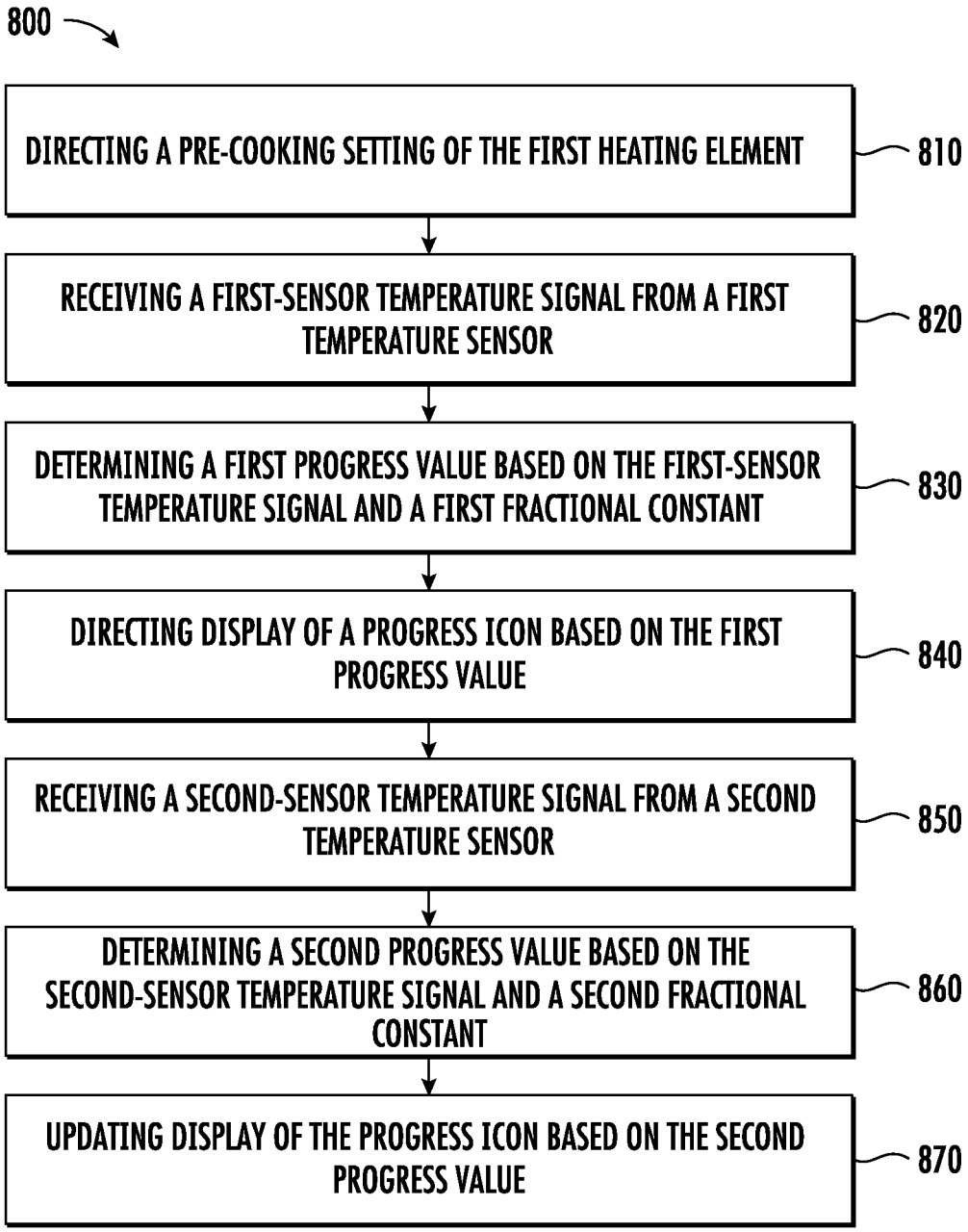
FIG. 8 is a flow chart illustrating of method of operating an oven appliance according to exemplary embodiments of the present disclosure.

Turning especially to FIG. 8, at 810, the method 800 includes directing a pre-cooking (e.g., preheating or recharge) setting of a first (e.g., bottom or, alternatively, top) heating element. The pre-cooking setting may provide a positive power output (e.g., duty cycle or percentage) for the first heating element as part of a corresponding pre-heating cycle. Thus, 810 may activate the first heating element. The activation may occur, moreover, from an inactive state, such as when the oven appliance is not actively generating heat within the cooking chamber (e.g., in a pre-cooking phase that is a preheating phase). Alternatively, the pre-cooking setting may provide a nil or negligible power output (e.g., duty cycle or percent) for the first heating element as part of the corresponding pre-heating cycle (e.g., in a pre-cooking phase that is a recharge phase). Thus, 810 may direct or hold the first heating element in the inactive state.

In some embodiments, prior to 810, the method 800 includes receiving a first preliminary signal from a first temperature sensor (e.g., bottom temperature sensor or, alternatively, oven temperature sensor). In particular, the first preliminary signal may be detected and received while the first heating element is held in a generally inactive state. Additionally or alternatively, the first preliminary signal may be detected and received while a second (e.g., top or, alternatively, bottom) heating element is held in a generally inactive state. In some such embodiments, the first preliminary signal corresponds to temperature within the cooking chamber while none of the heating elements for the cooking chamber are active (e.g., all held in corresponding inactive states). Thus, temperature prior to or immediately after starting active heat generation may be measured.

At 820, the method 800 includes receiving a first-sensor temperature signal from the first temperature sensor. Specifically, the first-sensor temperature signal is received during the pre-cooking setting of the first heating element. Thus, the first-sensor temperature signal is received while the first heating element is being directed to the pre-cooking setting. In the case of the first heating element being a bottom heating element, the first temperature sensor may be a bottom temperature sensor (e.g., disposed below the cooking surface or proximal to the bottom heating element, as described above). In the case of the first heating element being a top heating element, the first temperature sensor may be an oven temperature sensor (e.g., disposed above the cooking surface or proximal to the top heating element, as described above).

At 830, the method 800 includes determining a first progress value ($V_1$) based on the first-sensor temperature signal of 820 and a first fractional constant ($F_{C-1}$). The first fractional constant $F_{C-1}$ may be a predetermined proportion of a pre-cooking phase. Such a fractional constant $F_{C-1}$ may be empirically determined, for instance, based on testing of a representative model of the oven appliance (e.g., as a percentage of occurrence or empirical average slope of a corresponding portion of a pre-cooking phase). Optionally, the first fractional constant $F_{C-1}$ may be greater than 50% (e.g., greater than or equal to 51%, 70%, 80%, or 85%).

In some embodiments, 830 includes using the first fractional constant $F_{C-1}$ to modify some variable value that is calculated with the first-sensor temperature signal (e.g., the value of the temperature indicated by the first-sensor temperature signal). In such embodiments, a first-sensor variable ($X_1$) is calculated based on the first-sensor temperature signal ($T_{x-1}$). Thus, $X_1$ may be a function of $T_{x-1}$. Moreover, $X_1$ may be modified (e.g., multiplied) by $F_{C-1}$. In other words, the first progress value $V_1$ may be represented as:

$$V_1=F_{C-1}*X_1$$

Along with being based on the first-sensor temperature signal $T_{x-1}$, the first-sensor variable $X_1$ may be based on a predetermined first-element pre-cooking threshold ($T_{t-1}$), such as Bp or Rmin. For instance, the first-sensor variable $X_1$ may include a fraction calculated with $T_{x-1}$ in the numerator and $T_{t-1}$ in the denominator. In some such embodiments, the first element variable $X_1$ is further based on the first preliminary signal ($T_{0-1}$). For instance, the first preliminary signal $T_{0-1}$ may offset (e.g., be added to or subtracted from) first-sensor temperature signal $T_{x-1}$ in the numerator or offset (e.g., be added to or subtracted from) first-element pre-cooking threshold $T_{t-1}$. As an example, and as may be the case in a preheating phase, the first-sensor variable $X_1$ may be represented as:

$$X_1=(T_{x-1}-T_{0-1})/(T_{t-1}-T_{0-1})$$

As an additional or alternative example, and as may be the case in a recharge phase, the first-sensor variable $X_1$ may be represented as:

$$X_1=(T_{0-1}-T_{x-1})/(T_{0-1}-T_{t-1})$$

In additional or alternative embodiments, 830 includes using the first fractional constant $F_{C-1}$ to modify some variable value that is contingent on (e.g., as a binary choice that depends on) the first-sensor temperature signal $T_{x-1}$ (e.g., the value of the temperature indicated by the first-sensor temperature signal $T_{x-1}$). As an example, first-sensor temperature signal $T_{x-1}$ may be compared to a predetermined threshold (e.g., minimum threshold), such as Rmin in the case of a recharge phase. If first-sensor temperature signal $T_{x-1}$ is less than the predetermined threshold, the predetermined threshold may be substituted for the first-sensor temperature signal $T_{x-1}$ (e.g., in the calculation of $X_1$).

At 840, the method 800 includes directing display of a progress icon based on the first progress value. In other words, the progress icon may be illuminated or charged to present an image that provides a pictorial approximation or numerical representation of the first progress value (e.g., as a relative proportion of the entire time anticipated for the pre-cooking phase). In some embodiments, the progress icon is updated from an empty or starting point (e.g., to indicate progress of the pre-cooking phase has occurred).

As would be understood, 820 through 840 may be repeated (e.g., at regular or set intervals) while the first heating element remains in the pre-cooking setting or prior to a first-element pre-cooking threshold being met. Thus, the first progress value may be repeatedly recalculated to update the progress icon as the pre-cooking phase continues with the first heating element in a corresponding pre-cooking setting.

At 850, the method 800 includes receiving a second-sensor temperature signal from a second temperature sensor. Specifically, the second-sensor temperature signal is received after or with 820 and at a sensor apart from the first temperature sensor. For instance, if the first temperature sensor is a bottom temperature sensor, the second temperature sensor may be an oven temperature sensor. By contrast, if the first temperature sensor is an oven temperature sensor, the second temperature sensor may be a bottom sensor.

In some embodiments, 850 occurs after the first heating element has been directed to an inactive state from the pre-cooking setting (e.g., of 810). For instance, prior to 850, the method 800 may include determining the first-element pre-cooking threshold (e.g., Bp or Rmin) is met (e.g., exceeded in the case of a maximum threshold, such as Bp; or, alternatively, remaining below in the case of a minimum threshold, such as Rmin). Based on such a determination, the method 800 may provide for directing the first heating element to an inhibited state (e.g., inactive or, alternatively, reduced state, such as between 0% and 25%), which may be irrespective of the pre-cooking setting of 810.

In certain embodiments, a second (e.g., top or, alternatively, bottom) heating element apart from the first (e.g., bottom or, alternatively, top) heating element is activated based on determining the first-element pre-cooking threshold is met. Thus, the method 800 may further include directing a pre-cooking (e.g., preheating or recharge) setting of the second heating element. The pre-cooking setting of the second heating element may provide a positive power output (e.g., duty cycle or percentage) for the second heating element as part of a corresponding pre-heating cycle.

In some embodiments, prior to activating the second heating element, the method 800 includes receiving a second preliminary signal from a second temperature sensor (e.g., oven temperature sensor or, alternatively, bottom temperature sensor). In particular, the second preliminary signal may be detected and received while the first heating element is held in a generally inactive state. Additionally or alternatively, the first preliminary signal may be detected and received while a second (e.g., top or, alternatively, bottom) heating element is held in a generally inactive state. In some such embodiments, the second preliminary signal corresponds to temperature within the cooking chamber while none of the heating elements for the cooking chamber are active (e.g., all held in corresponding inactive states). Thus, temperature between moments of active heat generation may be measured.

At 860, the method 800 includes determining a second progress value ($V_2$) based on the second-sensor temperature signal of 850 and a second fractional constant ($F_{C-2}$). The second fractional constant $F_{C-2}$ may be a predetermined proportion of a pre-cooking phase. Such a fractional constant $F_{C-2}$ may be empirically determined, for instance, based on testing of a representative model of the oven appliance (e.g., as a percentage of occurrence or empirical average slope of a corresponding portion of a pre-cooking phase). Additionally or alternatively, $F_{C-2}$ may be the remaining portion of the pre-cooking phase after $F_{C-1}$ (e.g., $F_{C-2}=1-F_{C-1}$). Further additionally or alternatively, $F_{C-2}$ may be less than $F_{C-1}$. Optionally, the second fractional constant $F_{C-2}$ may be less than 50% (e.g., less than or equal to 49%, 30%, 20%, or 15%).

In some embodiments, 860 includes using the second fractional constant $F_{C-2}$ to modify some variable value that is calculated with the second-sensor temperature signal $T_{x-2}$ (e.g., the value of the temperature indicated by the second-sensor temperature signal $T_{x-2}$). In such embodiments, a second-sensor variable ($X_2$) is calculated based on the second-sensor temperature signal ($T_{x-2}$). Thus, $X_2$ may be a function of $T_{x-2}$. Moreover, $X_2$ may be modified (e.g., multiplied) by $F_{C-2}$. In other words, the second progress value $V_2$ may be represented as:

$$V_2=F_{C-2}*X_2$$

Along with being based on the second-sensor temperature signal $T_{x-2}$, the second-sensor variable $X_2$ may be based on a predetermined second-element pre-cooking threshold ($T_{t-2}$), such as Op or Rmax. For instance, the second-sensor variable $X_2$ may include a fraction calculated with $T_{x-2}$ in the numerator and $T_{t-2}$ in the denominator. In some such embodiments, the second element variable $X_2$ is further based on the second preliminary signal ($T_{0-2}$). For instance, the second preliminary signal $T_{0-2}$ may offset (e.g., be added to or subtracted from) second-sensor temperature signal $T_{x-2}$ in the numerator or offset (e.g., be added to or subtracted from) second-element pre-cooking threshold $T_{t-2}$. As an example, and as may be the case in a preheating phase or a recharge phase, the second-sensor variable $X_2$ may be represented as:

$$X_2=(T_{x-2}-T_{0-2})/(T_{t-2}-T_{0-2})$$

In additional or alternative embodiments, 860 includes using the second fractional constant $F_{C-2}$ to modify some variable value that is contingent on (e.g., as a binary choice that depends on) the second-sensor temperature signal $T_{x-2}$ (e.g., the value of the temperature indicated by the second-sensor temperature signal $T_{x-2}$). As an example, second-sensor temperature signal $T_{x-2}$ may be compared to the second preliminary signal $T_{0-2}$, such as in the case of a recharge phase. If second-sensor temperature signal $T_{x-2}$ is less than the second preliminary signal $T_{0-2}$, the second preliminary signal $T_{0-2}$ may be substituted for the second-sensor temperature signal $T_{x-2}$ (e.g., in the calculation of $X_2$).

At 870, the method 800 includes updating display of the progress icon based on the second progress value. For instance, the second progress value may be added to the latest first progress value or $F_{C-1}$ such that the combination of the first and second progress values are directed to display of a progress icon. In other words, the progress icon may be illuminated or charged to present an image that provides a pictorial approximation or numerical representation of the second progress value (e.g., as a relative proportion of the entire time anticipated for the pre-cooking phase).

As would be understood, 850 through 870 may be repeated (e.g., at regular intervals) while the second heating element remains in the pre-cooking setting, prior to a second-element pre-cooking threshold being met, until the progress icon shows a completed icon at a finish point, or until the pre-cooking process is otherwise complete. Thus, the second progress value may be repeatedly recalculated to update the progress icon as the pre-cooking phase continues with the second heating element in a corresponding pre-cooking setting.

Following the end of the pre-cooking phase, the method 800 may proceed to a maintenance or cooking phase, as would be understood.

Figure 9:
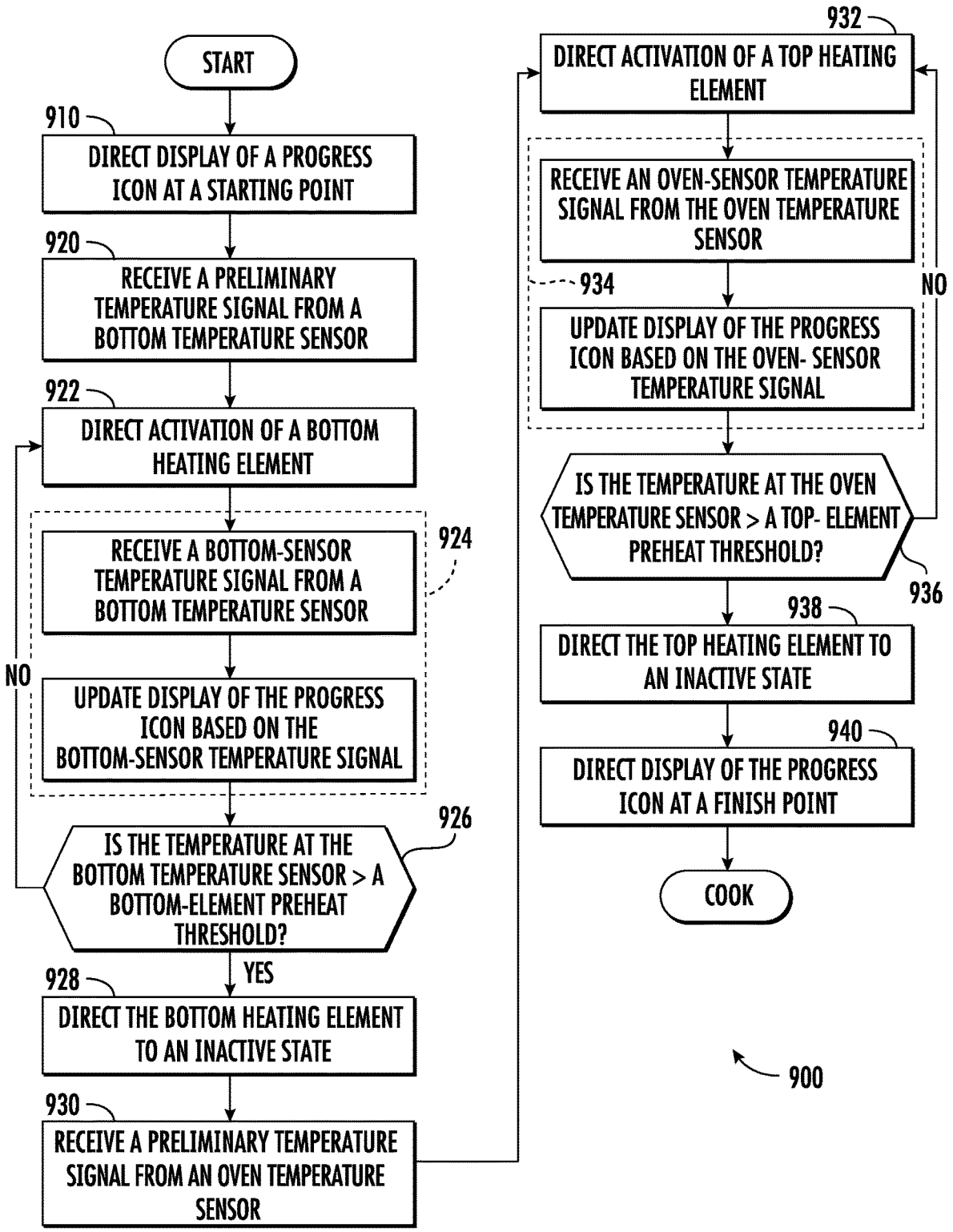
FIG. 9 is a flow chart illustrating of method of operating an oven appliance according to exemplary embodiments of the present disclosure.

Turning now to FIG. 9, at 910, the method 900 includes directing display of a progress icon at a starting point of a preheating phase. In other words, the progress icon may be illuminated or charged to present an image that provides an indication that the preheating phase has started and no substantial progress has been made. For instance, the progress icon may be shown as empty (to indicate a count up to completion of the preheating phase) or full (to indicate a countdown until completion of the preheating phase).

At 920, the method 900 includes receiving a preliminary signal ($T_{0-bottom}$) (see e.g., FIG. 6) from a bottom temperature sensor. In particular, $T_{0-bottom}$ may be detected and received while the bottom heating element is held in an inactive or generally inactive state, such as prior to or during the initial time period (e.g., less than 15 seconds) following activation of the bottom heating element. Additionally or alternatively, $T_{0-bottom}$ may be detected and received while the top heating element is held in an inactive or generally inactive state, such as prior to or during the initial time period (e.g., less than 15 seconds) following activation of the top heating element. In some such embodiments, $T_{0-bottom}$ corresponds to temperature within the cooking chamber while none of the heating elements for the cooking chamber are active (e.g., all held in corresponding inactive states). Thus, temperature prior to or immediately after starting active heat generation of the preheating phase may be measured.

At 922, the method 900 includes directing activation of the bottom heating element according to a preheat cycle (e.g., at a bottom heat output setting of the preheat cycle). The preheat cycle may provide a bottom heat output setting for the bottom heating element that is a positive power output (e.g., duty cycle or percentage). The activation may continue at the bottom heat output setting while the top heating element is held in a comparatively reduced state (e.g., inactive state or an active state that is otherwise lower than the bottom heating element) and until an intervening step occurs.

At 924, the method 900 includes refreshing the progress icon based on a bottom-sensor temperature signal ($T_{x-bottom}$) (e.g., along TL-1—FIG. 6) that is received from the bottom temperature sensor. Moreover, $T_{x-bottom}$ is received during the preheating cycle and activation of the bottom heating element. Once received, $T_{x-bottom}$ may be used to determine a new relative value for the progress icon. For instance, a first progress value ($V_1$) may be calculated based on $T_{x-bottom}$ and a first preheat fractional constant ($F_{P-1}$). The constant value of $F_{P-1}$ may be a predetermined proportion of the preheating phase. As would be understood, $F_{P-1}$ may be empirically determined, for instance, based on testing of a representative model of the oven appliance (e.g., as a percentage of occurrence or empirical average slope of a corresponding portion of a preheating phase). Optionally, $F_{P-1}$ may be greater than 50% (e.g., greater than or equal to 51%, 70%, 80%, or 85%).

In some embodiments, $F_{P-1}$ modifies a bottom-sensor variable $X_1$ calculated with $T_{x-bottom}$ (e.g., the value of the temperature indicated by $T_{x-bottom}$). In such embodiments, $X_1$ is calculated based on $T_{x-bottom}$. Thus, $X_1$ may be a function of $T_{x-bottom}$. Moreover, $X_1$ may be modified (e.g., multiplied) by $F_{P-1}$. In other words, $V_1$ may be represented as:

$$V_1=F_{P-1}*X_1$$

Along with being based on $T_{x\text{-}bottom}$, $X_1$ may be based on a predetermined bottom-element preheating threshold (Bp) (see e.g., FIG. 6). For instance, $X_1$ may include a fraction calculated with $T_{x\text{-}bottom}$ in the numerator and Bp in the denominator. In some such embodiments, $X_1$ is further based on $T_{0\text{-}bottom}$. For instance, $T_{0\text{-}bottom}$ may offset (e.g., be added to or subtracted from) $T_{x\text{-}bottom}$ in the numerator or offset (e.g., be added to or subtracted from) Bp. As an example, and as may be the case in a preheating phase, $X_1$ may be represented as:

$$X_1=(T_{x\text{-}bottom}-T_{0\text{-}bottom})/(Bp\times T_{0\text{-}bottom})$$

Once $V_1$ is calculated, the progress icon may be updated accordingly. In other words, the progress icon may be illuminated or charged to present an image that provides a pictorial approximation or numerical representation of $V_1$ (e.g., as a relative proportion of the entire time anticipated for the preheating phase).

At 926, following an instance of 924, the method 900 includes evaluating temperature at the bottom temperature sensor. The evaluation may include comparing the temperature at the bottom temperature sensor ($T_{x\text{-}bottom}$) to Bp. Specifically, if $T_{x\text{-}bottom}\leq Bp$, the method 900 may return to 922. By contrast, if $T_{x\text{-}bottom}>Bp$, the method 900 may proceed to 928.

At 928, the method 900 includes directing the bottom heating element to an inactive state. In the other words, the bottom heat output setting may be halted and the bottom heating element is turned off. The bottom heating element may be held in an inactive state for a set period of time (e.g., before proceeding to 930) or, alternatively, proceed immediately to 930.

At 930, the method 900 includes a preliminary signal ($T_{0\text{-}oven}$) (see e.g., FIG. 6) from an oven temperature sensor. In particular, the preliminary signal $T_{0\text{-}oven}$ may be detected and received while the top heating element and bottom heating element are held in an inactive state. In such embodiments, the preliminary signal $T_{0\text{-}oven}$ corresponds to temperature within the cooking chamber while none of the heating elements for the cooking chamber are active (e.g., all held in corresponding inactive or generally inactive states, such as prior to or during the initial time period—e.g., less than 15 seconds-following activation of the heating elements).

It is noted that although 930 is shown as following 922, 924, 926, and 928, alternative embodiments may execute 930 prior to such steps. For instance, signal ($T_{0\text{-}oven}$) may be gathered prior to activation of the bottom heating element. Optionally, 930 may be executed or performed in tandem with 920 prior to 922.

At 932, the method 900 includes directing activation of the top heating element according to a preheat cycle (e.g., at a top heat output setting of the preheat cycle). The preheat cycle may provide a top heat output setting for the top heating element that is a positive power output (e.g., duty cycle or percentage). The activation may continue at the top heat output setting while the bottom heating element is held in a comparatively reduced state (e.g., inactive state or an active state that is otherwise lower than the top heating element) and until an intervening step occurs.

At 934, the method 900 includes refreshing the progress icon based on an oven-sensor temperature signal ($T_{x\text{-}oven}$) (e.g., along TL-2—FIG. 6) that is received from the oven temperature sensor. Moreover, $T_{x\text{-}oven}$ is received during the preheating cycle and activation of the top heating element. Once received, $T_{x\text{-}oven}$ may be used to determine a new relative value for the progress icon. For instance, a second progress value ($V_2$) may be calculated based on $T_{x\text{-}bottom}$ and a second preheat fractional constant ($F_{F\text{-}2}$). The constant value of $F_{F\text{-}2}$ may be a predetermined proportion of the preheating phase. As would be understood, $F_{F\text{-}2}$ may be empirically determined, for instance, based on testing of a representative model of the oven appliance (e.g., as a percentage of occurrence or empirical average slope of a corresponding portion of a preheating phase). Additionally or alternatively, $F_{F\text{-}2}$ may be the remaining portion of the preheating phase after $F_{P\text{-}1}$ (e.g., $F_{F\text{-}2}=1-F_{P\text{-}1}$). Further additionally or alternatively, $F_{P\text{-}2}$ may be less than $F_{P\text{-}1}$. Optionally, the second fractional constant $F_{P\text{-}2}$ may be less than 50% (e.g., less than or equal to 49%, 30%, 20%, or 15%).

In some embodiments, $F_{P\text{-}2}$ modifies an oven-sensor variable $X_2$ calculated with $T_{x\text{-}oven}$ (e.g., the value of the temperature indicated by $T_{x\text{-}oven}$). In such embodiments, $X_2$ is calculated based on $T_{x\text{-}oven}$. Thus, $X_2$ may be a function of $T_{x\text{-}oven}$. Moreover, $X_2$ may be modified (e.g., multiplied) by $F_{P\text{-}2}$. In other words, $V_2$ may be represented as:

$$V_2=F_{F\text{-}2}*X_2$$

Along with being based on $T_{x\text{-}oven}$, $X_2$ may be based on a predetermined top-element preheating threshold (Op) (see e.g., FIG. 6). For instance, $X_2$ may include a fraction calculated with $T_{x\text{-}oven}$ in the numerator and Op in the denominator. In some such embodiments, $X_2$ is further based on $T_{0\text{-}oven}$. For instance, $T_{0\text{-}oven}$ may offset (e.g., be added to or subtracted from) $T_{x\text{-}oven}$ in the numerator or offset (e.g., be added to or subtracted from) Op. As an example, and as may be the case in a preheating phase, $X_2$ may be represented as:

$$X_2=(T_{x\text{-}oven}-T_{0\text{-}oven})/(Op-T_{0\text{-}oven})$$

Once $V_2$ is calculated, the progress icon may be updated accordingly. In other words, the progress icon may be illuminated or charged to present an image that provides a pictorial approximation or numerical representation of $V_2$ (e.g., as a relative proportion of the entire time anticipated for the preheating phase). For instance, $V_2$ may be added to the latest $V_1$ or $F_{P\text{-}1}$ such that the combination of the first and second progress values are directed to display of a progress icon. In other words, the progress icon may be illuminated or charged to present an image that provides a pictorial approximation or numerical representation of the second progress value (e.g., as a relative proportion of the entire time anticipated for the preheating phase).

At 936, following an instance of 934, the method 900 includes evaluating temperature at the oven temperature sensor. The evaluation may include comparing the temperature at the oven temperature sensor (e.g., $T_{x\text{-}oven}$) to Op. Specifically, if $T_{x\text{-}oven}\leq Op$, the method 900 may return to 932. By contrast, if $T_{x\text{-}oven}>Op$, the method 900 may proceed to 938.

At 938, the method 900 includes directing the top heating element to an inactive state. In the other words, the top heat output setting may be halted and the top heating element is turned off. The top heating element may be held in an inactive state for a set period of time (e.g., before proceeding to 940) or, alternatively, proceed immediately to 940.

At 940, the method 900 includes directing display of a progress icon at a finish point of a preheat phase. In other words, the progress icon may be illuminated or charged to present an image that provides an indication that the preheating phase has finished and conditions for the preheating phase have been completed. For instance, the progress icon may be shown as full (to indicate a count up to completion of the preheating phase) or empty (to indicate a countdown until completion of the preheating phase).

Following the end of the preheating phase, the method 900 may proceed to a maintenance or cooking phase, as would be understood.

Figure 10:
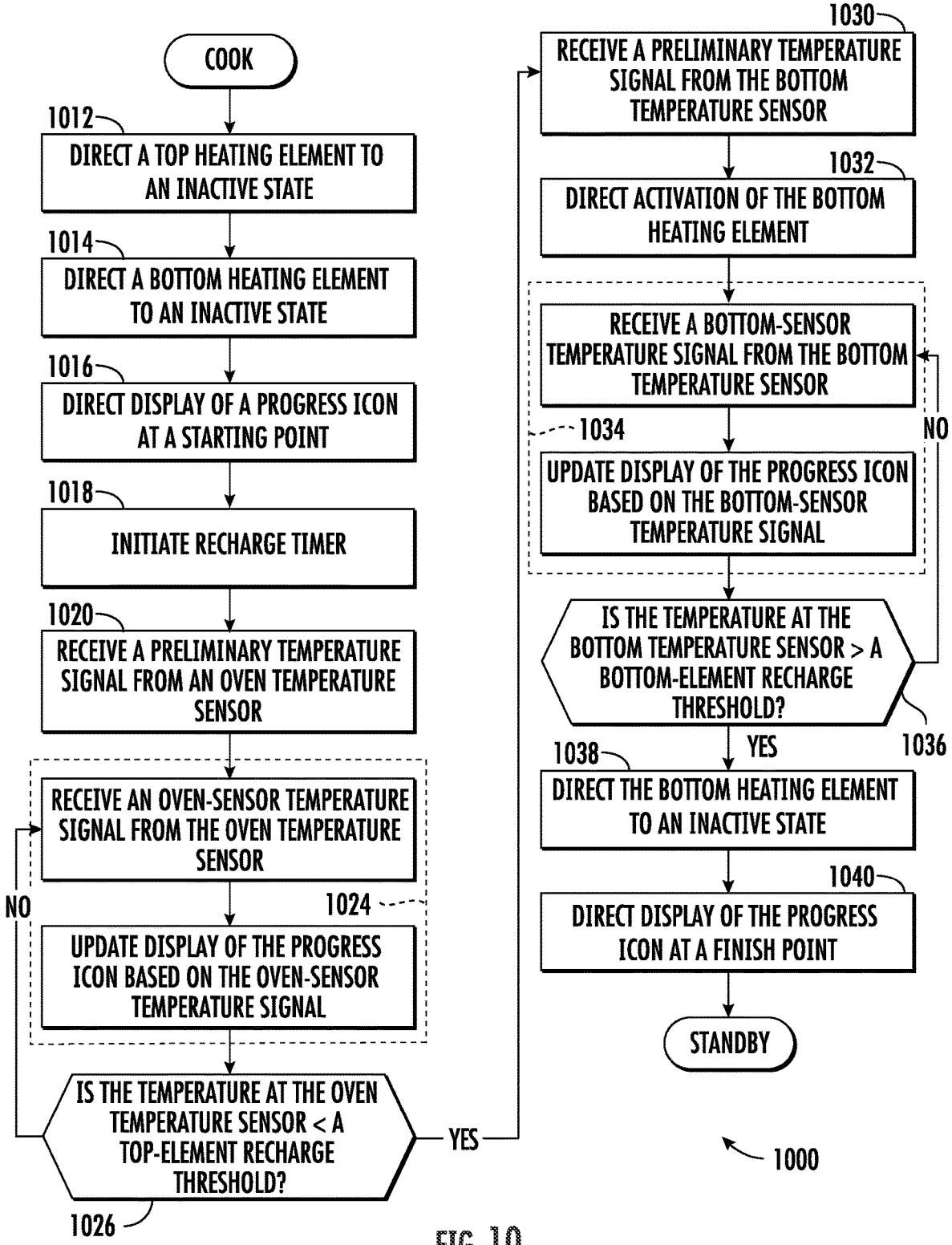
FIG. 10 is a flow chart illustrating of method of operating an oven appliance according to exemplary embodiments of the present disclosure.

Turning now to FIG. 10, at 1012, the method 1000 includes directing a top heating element to an inactive state for a recharge phase (e.g., following a cooking phase). In the other words, the top heat output setting may be halted and the top heating element is turned off. The top heating element may be held in an inactive state for a set period of time (e.g., before proceeding to 1020) or, alternatively, proceed immediately to one or more subsequent steps.

At 1014, the method 1000 includes directing a bottom heating element to an inactive state for the recharge phase (e.g., following the cooking phase). In the other words, the top heat output setting may be halted and the bottom heating element is turned off (e.g., separate from or simultaneously with 1012). The bottom heating element may be held in an inactive state for a set period of time (e.g., before proceeding to 1020) or, alternatively, proceed immediately to one or more subsequent steps.

At 1016, the method 1000 includes directing display of a progress icon at a starting point of the recharge phase. In other words, the progress icon may be illuminated or charged to present an image that provides an indication that the recharge phase has started and no substantial progress has been made. For instance, the progress icon may be shown as empty (to indicate a count up to completion of the recharge phase) or full (to indicate a countdown until completion of the recharge phase).

At 1018, method 1000 includes initiating or starting a recharge timer (e.g., measuring a set period of time at the beginning of the recharge phase). Thus, the passage of the set period of time for the recharge phase may be measured. Once the recharge timer has expired, the method 1000 may proceed to 1020.

It is noted that the progress icon may continue to update or refresh while the recharger timer proceeds. Such updates at this portion of the recharge phase may be based on testing of a representative model of the oven appliance (e.g., as a percentage of occurrence or empirical average slope of a corresponding portion of a recharge phase). In other words, a predetermined portion of the recharge phase time may be covered by the set period of time of the recharge timer. This predetermined portion or constant value may be represented as a preliminary recharge fractional constant ($F_{R\text{-}0}$). As the recharge timer elapses, a preliminary progress value ($V_0$) based on $F_{R\text{-}0}$ may vary accordingly. Specifically, along with being based on $F_{R\text{-}0}$, $V_0$ may be calculated based on the current recharge time ($t_{current}$) at the recharge timer over the total time ($t_{timer}$) of the recharge timer. In other words, $V_0$ may be represented as:

$$V_0=F_{R\text{-}0}*(t_{current}/t_{timer})$$

Once $V_0$ is calculated, the progress icon may be updated accordingly. In other words, the progress icon may be illuminated or charged to present an image that provides a pictorial approximation or numerical representation of $V_0$ (e.g., as a relative proportion of the entire time anticipated for the recharge phase). Such calculations and updates to the progress icon may be repeated as the recharge timer elapses.

At 1020, the method 1000 includes receiving a preliminary signal ($T_{0\text{-}oven}$) (see e.g., FIG. 6) from an oven temperature sensor. In particular, the preliminary signal $T_{r0\text{-}oven}$ may be detected and received while the heating elements are held in an inactive state. Thus, the preliminary signal $T_{r0\text{-}oven}$ corresponds to temperature within the cooking chamber while none of the heating elements for the cooking chamber are active (e.g., all held in corresponding inactive states). Moreover, temperature after the recharge timer has expired may be measured.

At 1024, the method 1000 includes refreshing the progress icon based on an oven-sensor temperature signal ($T_{x\text{-}oven}$) (e.g., along TL-2—FIG. 6) that is received from the oven temperature sensor. Moreover, $T_{x\text{-}oven}$ is received while the heating elements remain inactive. Once received, $T_{x\text{-}oven}$ may be used to determine a new relative value for the progress icon. For instance, a first progress value ($V_1$) may be calculated based on $T_{x\text{-}oven}$ and a first recharge fractional constant ($F_{R\text{-}1}$). The constant value of $F_{R\text{-}1}$ may be a predetermined proportion of the recharge phase. As would be understood, $F_{R\text{-}1}$ may be empirically determined, for instance, based on testing of a representative model of the oven appliance (e.g., as a percentage of occurrence or empirical average slope of a corresponding portion of a recharge phase). Optionally, $F_{R\text{-}1}$ may be greater than 50% (e.g., greater than or equal to 51%, 70%, 80%, or 85%).

In some embodiments, $F_{R\text{-}1}$ modifies an oven-sensor variable $X_1$ calculated with $T_{x\text{-}oven}$ (e.g., the value of the temperature indicated by $T_{x\text{-}oven}$). In such embodiments, $X_1$ is calculated based on $T_{x\text{-}oven}$. Thus, $X_1$ may be a function of $T_{x\text{-}oven}$. Moreover, $X_1$ may be modified (e.g., multiplied) by $F_{R\text{-}1}$. In other words, $V_1$ may be represented as:

$$V_1=F_{R\text{-}1}*X_1$$

Along with being based on $T_{x\text{-}oven}$, $X_1$ may be based on a predetermined top-element recharge threshold (Rmin) (see e.g., FIG. 6). For instance, $X_1$ may include a fraction calculated with $T_{x\text{-}oven}$ in the numerator and Rmin in the denominator. In some such embodiments, $X_1$ is further based on $T_{r0\text{-}oven}$. For instance, $T_{r0\text{-}oven}$ may offset (e.g., be added to or subtracted from) $T_{x\text{-}oven}$ in the numerator or offset (e.g., be added to or subtracted from) Rmin. As an example, and as may be the case in a recharge phase, $X_1$ may be represented as:

$$X_1=(T_{r0\text{-}oven}-T_{x\text{-}oven})/(T_{r0\text{-}oven}-R\text{min})$$

Once $V_1$ is calculated, the progress icon may be updated accordingly. In other words, the progress icon may be illuminated or charged to present an image that provides a pictorial approximation or numerical representation of $V_1$ (e.g., as a relative proportion of the entire time anticipated for the recharge phase). For instance, $V_1$ may be added to the latest $V_0$ such that the combination of the preliminary and first progress values are directed to display of a progress icon. In other words, the progress icon may be illuminated or charged to present an image that provides a pictorial approximation or numerical representation of the first progress value (e.g., as a relative proportion of the entire time anticipated for the recharge phase).

At 1026, following an instance of 1024, the method 1000 includes evaluating temperature at the oven temperature sensor. The evaluation may include comparing the temperature at the oven temperature sensor (e.g., $T_{x\text{-}oven}$) to Rmin. Specifically, if $T_{x\text{-}oven}\geq$Rmin, the method 1000 may return to 1024. By contrast, if $T_{x\text{-}oven}<$Rmin, the method 1000 may proceed to 1030.

At 1030, the method 1000 includes receiving a preliminary signal ($T_{r0\text{-}bottom}$) (see e.g., FIG. 6) from a bottom temperature sensor. In particular, Tro-bottom may be detected and received while the top heating element and bottom heating element are held in an inactive or generally inactive state, such as prior to or during the initial time period (e.g., less than 15 seconds) following activation of the heating elements. In such embodiments, the preliminary signal $T_{0\text{-}bottom}$ corresponds to temperature within the cooking chamber while none of the heating elements for the cooking chamber are active (e.g., all held in corresponding inactive or generally inactive states).

At 1032, the method 1000 includes directing activation of the bottom heating element according to a recharge cycle (e.g., at a bottom heat output setting of the recharge cycle). The recharge cycle may provide a bottom heat output setting for the top heating element that is a positive power output (e.g., duty cycle or percentage). The activation may continue at the bottom heat output setting while the top heating element is held in an inactive state and until an intervening step occurs.

At 1034, the method 1000 includes refreshing the progress icon based on a bottom-sensor temperature signal ($T_{x\text{-}bottom}$) (e.g., along TL-1—FIG. 6) that is received from the bottom temperature sensor. Moreover, $T_{x\text{-}bottom}$ is received during the recharge cycle and activation of the top heating element. Once received, $T_{x\text{-}bottom}$ may be used to determine a new relative value for the progress icon. For instance, a second progress value ($V_2$) may be calculated based on $T_{x\text{-}bottom}$ and a second preheat fractional constant ($F_{R\text{-}2}$). The constant value of $F_{R\text{-}2}$ may be a predetermined proportion of the recharge phase. As would be understood, $F_{R\text{-}2}$ may be empirically determined, for instance, based on testing of a representative model of the oven appliance (e.g., as a percentage of occurrence or empirical average slope of a corresponding portion of a recharge phase). Additionally or alternatively, $F_{F\text{-}2}$ may be the remaining portion of the recharge phase after $F_{R\text{-}1}$ (e.g., $F_{R\text{-}2}=1-F_{R\text{-}1}$). Further additionally or alternatively, $F_{R\text{-}2}$ may be less than $F_{R\text{-}1}$. Optionally, the second fractional constant $F_{R\text{-}2}$ may be less than 50% (e.g., less than or equal to 49%, 30%, 20%, or 15%).

In some embodiments, $F_{R\text{-}2}$ modifies an oven-sensor variable $X_2$ calculated with $T_{x\text{-}bottom}$ (e.g., the value of the temperature indicated by $T_{x\text{-}bottom}$). In such embodiments, $X_2$ is calculated based on $T_{x\text{-}bottom}$. Thus, $X_2$ may be a function of $T_{x\text{-}bottom}$. Moreover, $X_2$ may be modified (e.g., multiplied) by $F_{R\text{-}2}$. In other words, $V_2$ may be represented as:

$$V_2=F_{R\text{-}2}*X_2$$

Along with being based on $T_{x\text{-}bottom}$, $X_2$ may be based on a predetermined bottom-element recharge threshold (Rmax) (see e.g., FIG. 6). For instance, $X_2$ may include a fraction calculated with $T_{x\text{-}bottom}$ in the numerator and Rmax in the denominator. In some such embodiments, $X_2$ is further based on $T_{r0\text{-}bottom}$. For instance, $T_{0\text{-}bottom}$ may offset (e.g., be added to or subtracted from) $T_{x\text{-}bottom}$ in the numerator or offset (e.g., be added to or subtracted from) Rmax. As an example, and as may be the case in a recharge phase, $X_2$ may be represented as:

$$X_2=(T_{x\text{-}bottom}-T_{r0\text{-}bottom})/(R\max-T_{r0\text{-}bottom})$$

Once $V_2$ is calculated, the progress icon may be updated accordingly. In other words, the progress icon may be illuminated or charged to present an image that provides a pictorial approximation or numerical representation of $V_2$ (e.g., as a relative proportion of the entire time anticipated for the preheating phase). For instance, $V_2$ may be added to the latest $V_0$ or $V_1$ such that the combination of the preliminary, first, and second progress values are directed to display of a progress icon. In other words, the progress icon may be illuminated or charged to present an image that provides a pictorial approximation or numerical representation of the second progress value (e.g., as a relative proportion of the entire time anticipated for the recharge phase).

At 1036, following an instance of 1034, the method 900 includes evaluating temperature at the bottom temperature sensor. The evaluation may include comparing the temperature at the bottom temperature sensor (e.g., $T_{x\text{-}bottom}$) to Rmax. Specifically, if $T_{x\text{-}bottom}\leq$Rmax, the method 1000 may return to 1034. By contrast, if $T_{x\text{-}bottom}>$Rmax, the method 1000 may proceed to 1038.

At 1038, the method 1000 includes directing the bottom heating element to an inactive state. In the other words, the bottom heat output setting may be halted and the bottom heating element is turned off. The bottom heating element may be held in an inactive state for a set period of time (e.g., before proceeding to 1040) or, alternatively, proceed immediately to 1040.

At 1040, the method 1000 includes directing display of a progress icon at a finish point of a recharge phase. In other words, the progress icon may be illuminated or charged to present an image that provides an indication that the recharge phase has finished and conditions for the recharge phase have been completed. For instance, the progress icon may be shown as full (to indicate a count up to completion of the recharge phase) or empty (to indicate a countdown until completion of the recharge phase).

Following the end of the recharge phase, the method 1000 may proceed to a maintenance or cooking phase, as would be understood.

Figure 11:
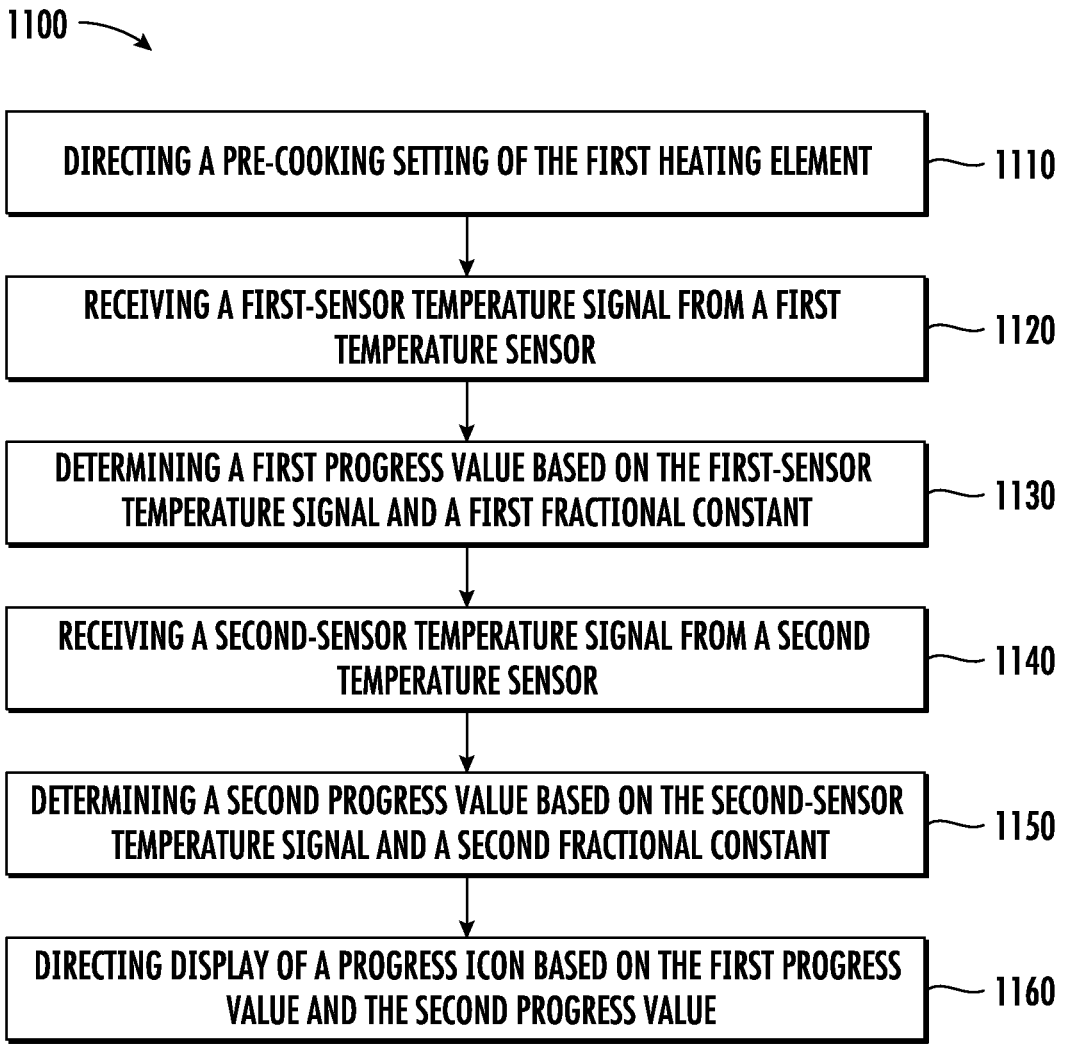
FIG. 11 is a flow chart illustrating of method of operating an oven appliance according to exemplary embodiments of the present disclosure.

Turning now to FIG. 11, at 1110, the method 1100 includes directing a pre-cooking (e.g., preheating or recharge) setting of a first (e.g., bottom or, alternatively, top) heating element. The pre-cooking setting may provide a positive power output (e.g., duty cycle or percentage) for the first heating element as part of a corresponding pre-heating cycle. Thus, 1110 may activate the first heating element. The activation may occur, moreover, from an inactive or generally inactive state, such as when the oven appliance is not actively generating heat within the cooking chamber (e.g., in a pre-cooking phase that is a preheating phase). Alternatively, the pre-cooking setting may provide a nil or negligible power output (e.g., duty cycle or percent) for the first heating element as part of the corresponding pre-heating cycle (e.g., in a pre-cooking phase that is a recharge phase). Thus, 1110 may direct or hold the first heating element in the inactive state.

In some embodiments, prior to 1110, the method 1100 includes receiving a first preliminary signal from a first temperature sensor (e.g., bottom temperature sensor or, alternatively, oven temperature sensor). In particular, the first preliminary signal may be detected and received while the first heating element is held in a generally inactive state. Additionally or alternatively, the first preliminary signal may be detected and received while a second (e.g., top or, alternatively, bottom) heating element is held in a generally state. In some such embodiments, the first preliminary signal corresponds to temperature within the cooking chamber while none of the heating elements for the cooking chamber are active (e.g., all held in corresponding inactive states). Thus, temperature prior to or immediately after starting active heat generation may be measured.

In additional or alternative embodiments, prior to 1110, the method 1100 includes receiving a second preliminary signal from a second temperature sensor (e.g., oven temperature sensor or, alternatively, bottom temperature sensor). In particular, the second preliminary signal may be detected and received while the second heating element is held in a generally inactive state. Additionally or alternatively, the second preliminary signal may be detected and received while a second (e.g., top or, alternatively, bottom) heating element is held in a generally inactive state. In some such embodiments, the second preliminary signal corresponds to temperature within the cooking chamber while none of the heating elements for the cooking chamber are active (e.g., all held in corresponding inactive states). Thus, temperature prior to or immediately after starting active heat generation may be measured.

At 1120, the method 1100 includes receiving a first-sensor temperature signal from a first temperature sensor. Specifically, the first-sensor temperature signal is received during the pre-cooking setting of the first heating element. Thus, the first-sensor temperature signal is received while the first heating element is being directed to the pre-cooking setting. In the case of the first heating element being a bottom heating element, the first temperature sensor may be a bottom temperature sensor (e.g., disposed below the cooking surface or proximal to the bottom heating element, as described above). In the case of the first heating element being a top heating element, the first temperature sensor may be an oven temperature sensor (e.g., disposed above the cooking surface or proximal to the top heating element, as described above).

At 1130, the method 1100 includes determining a first progress value ($V_1$) based on the first-sensor temperature signal of 1120 and a first fractional constant ($F_{C\text{-}1}$). The first fractional constant $F_{C\text{-}1}$ may be a predetermined proportion of a pre-cooking phase. Such a fractional constant $F_{C\text{-}1}$ may be empirically determined, for instance, based on testing of a representative model of the oven appliance (e.g., as a percentage of occurrence or empirical average slope of a corresponding portion of a pre-cooking phase). Optionally, the first fractional constant $F_{C\text{-}1}$ may be greater than 50% (e.g., greater than or equal to 51%, 70%, 80%, or 85%).

In some embodiments, 1130 includes using the first fractional constant $F_{C\text{-}1}$ to modify some variable value that is calculated with the first-sensor temperature signal (e.g., the value of the temperature indicated by the first-sensor temperature signal). In such embodiments, a first-sensor variable ($X_1$) is calculated based on the first-sensor temperature signal ($T_{x\text{-}1}$). Thus, $X_1$ may be a function of $T_{x\text{-}1}$. Moreover, $X_1$ may be modified (e.g., multiplied) by $F_{C\text{-}1}$. In other words, the first progress value $V_1$ may be represented as:

$$V_1=F_{C\text{-}1}*X_1$$

Along with being based on the first-sensor temperature signal $T_{x\text{-}1}$, the first-sensor variable $X_1$ may be based on a predetermined first-element pre-cooking threshold ($T_{t\text{-}1}$), such as Bp or Rmin. For instance, the first-sensor variable $X_1$ may include a fraction calculated with $T_{x\text{-}1}$ in the numerator and $T_{t\text{-}1}$ in the denominator. In some such embodiments, the first element variable $X_1$ is further based on the first preliminary signal ($T_{0\text{-}1}$). For instance, the first preliminary signal $T_{0\text{-}1}$ may offset (e.g., be added to or subtracted from) first-sensor temperature signal $T_{x\text{-}1}$ or offset (e.g., be added to or subtracted from) first-element pre-cooking threshold $T_{t\text{-}1}$. As an example, and as may be the case in a preheating phase, the first-sensor variable $X_1$ may be represented as:

$$X_1=(T_{x\text{-}1}-T_{0\text{-}1})/(T_{t\text{-}1}-T_{0\text{-}1})$$

As an additional or alternative example, and as may be the case in a recharge phase, the first-sensor variable $X_1$ may be represented as:

$$X_1=(T_{0\text{-}1}-T_{x\text{-}1})/(T_{0\text{-}1}-T_{t\text{-}1})$$

In additional or alternative embodiments, 1130 includes using the first fractional constant $F_{C\text{-}1}$ to modify some variable value that is contingent on (e.g., as a binary choice that depends on) the first-sensor temperature signal $T_{x\text{-}1}$ (e.g., the value of the temperature indicated by the first-sensor temperature signal $T_{x\text{-}1}$).

At 1140, the method 1100 includes receiving a second-sensor temperature signal from the second temperature sensor. In some embodiments, the second-sensor temperature signal is received after or with 1120 and at a sensor apart from the first temperature sensor. For instance, if the first temperature sensor is a bottom temperature sensor, the second temperature sensor may be an oven temperature sensor. By contrast, if the first temperature sensor is an oven temperature sensor, the second temperature sensor may be a bottom sensor.

In some embodiments, 1140 occurs after the first heating element has been directed to an inactive state from the pre-cooking setting (e.g., of 1110). For instance, prior to 1140, the method 1100 may include determining the first-element pre-cooking threshold (e.g., Bp or Rmin) is met (e.g., exceeded in the case of a maximum threshold, such as Bp; or, alternatively, falling below in the case of a minimum threshold, such as Rmin). Based on such a determination, the method 1100 may provide for directing the first heating element to an inhibited state (e.g., inactive or, alternatively, reduced state, such as between 0% and 25%), which may be irrespective of the pre-cooking setting of 1110.

In certain embodiments, a second (e.g., top or, alternatively, bottom) heating element apart from the first (e.g., bottom or, alternatively, top) heating element is activated based on determining the first-element pre-cooking threshold is met. Thus, the method 1100 may further include directing a pre-cooking (e.g., preheating or recharge) setting of the second heating element. The pre-cooking setting of the second heating element may provide a positive power output (e.g., duty cycle or percentage) for the second heating element as part of a corresponding pre-heating cycle.

At 1150, the method 1100 includes determining a second progress value ($V_2$) based on the second-sensor temperature signal of 1140 and a second fractional constant ($F_{C\text{-}2}$). The second fractional constant $F_{C\text{-}2}$ may be a predetermined proportion of a pre-cooking phase. Such a fractional constant $F_{C\text{-}2}$ may be empirically determined, for instance, based on testing of a representative model of the oven appliance (e.g., as a percentage of occurrence or empirical average slope of a corresponding portion of a pre-cooking phase). Additionally or alternatively, $F_{C\text{-}2}$ may be the remaining portion of the pre-cooking phase after $F_{C\text{-}1}$ (e.g., $F_{C\text{-}2}=1-F_{C\text{-}1}$). Further additionally or alternatively, $F_{C\text{-}2}$ may be less than $F_{C\text{-}1}$. Optionally, the second fractional constant $F_{C\text{-}2}$ may be less than 50% (e.g., less than or equal to 49%, 30%, 20%, or 15%).

In some embodiments, 1150 includes using the second fractional constant $F_{C\text{-}2}$ to modify some variable value that is calculated with the second-sensor temperature signal $T_{x\text{-}2}$ (e.g., the value of the temperature indicated by the second-sensor temperature signal $T_{x\text{-}2}$). In such embodiments, a second-sensor variable ($X_2$) is calculated based on the second-sensor temperature signal ($T_{x\text{-}2}$). Thus, $X_2$ may be a function of $T_{x\text{-}2}$. Moreover, $X_2$ may be modified (e.g., multiplied) by $F_{C\text{-}2}$. In other words, the second progress value $V_2$ may be represented as:

$$V_2=F_{C\text{-}2}*X_2$$

Along with being based on the second-sensor temperature signal $T_{x\text{-}2}$, the second-sensor variable $X_2$ may be based on a predetermined second-element pre-cooking threshold ($T_{t\text{-}2}$), such as Op or Rmax. For instance, the second-sensor variable $X_2$ may include a fraction calculated with $T_{x\text{-}2}$ in the numerator and $T_{t-2}$ in the denominator. In some such embodiments, the second element variable $X_2$ is further based on the second preliminary signal ($T_{0-2}$). For instance, the second preliminary signal $T_{0-2}$ may offset (e.g., be added to or subtracted from) second-sensor temperature signal $T_{x-2}$ or offset (e.g., be added to or subtracted from) second-element pre-cooking threshold $T_{t-2}$. As an example, and as may be the case in a preheating phase or a recharge phase, the second-sensor variable $X_2$ may be represented as:

$$X_2=(T_{x-2}-T_{0-2})/(T_{t-2}-T_{0-2})$$

In additional or alternative embodiments, 1150 includes using the second fractional constant $F_{C-2}$ to modify some variable value that is contingent on (e.g., as a binary choice that depends on) the second-sensor temperature signal $T_{x-2}$ (e.g., the value of the temperature indicated by the second-sensor temperature signal $T_{x-2}$).

At 1160, the method 1100 includes directing display of a progress icon based on the first progress value and the second progress value For instance, the second progress value may be added to the latest first progress value or $F_{C-1}$ such that the combination of the first and second progress values are directed to display of a progress icon. In other words, the progress icon may be illuminated or charged to present an image that provides a pictorial approximation or numerical representation of the first and second progress values (e.g., as a relative proportion of the entire time anticipated for the pre-cooking phase). In some embodiments, the progress icon is updated from an empty or starting point (e.g., to indicate progress of the pre-cooking phase has occurred).

As would be understood, 1120 through 1160 may be repeated (e.g., at regular intervals) while the first or second heating element(s) remain(s) in the pre-cooking setting, until the progress icon shows a completed icon at a finish point, or until the pre-cooking process is otherwise complete. Thus, the first and second progress values may be repeatedly recalculated to update the progress icon as the pre-cooking phase continues with the second heating element in a corresponding pre-cooking setting.

Following the end of the pre-cooking phase, the method 1100 may proceed to a maintenance or cooking phase, as would be understood.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet;

a plurality of chamber walls mounted within the cabinet, the plurality of chamber walls defining a cooking chamber, the plurality of chamber walls comprising a back wall, a top wall, a first side wall, a second side wall, and a bottom wall;

a first heating element mounted within the cooking chamber;

a first temperature sensor disposed within the cabinet to detect a temperature proximal to the first heating element;

a second heating element mounted within the cooking chamber and spaced apart from the first heating element;

a second temperature sensor disposed within the cabinet to detect a temperature proximal to the second heating element; and a controller in operative communication with the first heating element, the first temperature sensor, the second heating element, and the second temperature sensor, the controller being configured to initiate a cooking operation comprising directing a pre-cooking setting of the first heating element, receiving a first-sensor temperature signal from the first temperature sensor, receiving the first-sensor temperature signal occurring during the pre-cooking setting of the first heating element, determining a first progress value based on the first-sensor temperature signal and a first fractional constant, the first fractional constant being a predetermined proportion of a pre-cooking phase, receiving a second-sensor temperature signal from the second temperature sensor, determining a second progress value based on the second-sensor temperature signal and a second fractional constant, the second fractional constant being a predetermined proportion of the pre-cooking phase, and directing display of a progress icon based on the first progress value and the second progress value.

2. The oven appliance of claim 1, wherein the cooking operation further comprises determining a first-element pre-cooking threshold is reached prior to receiving the second-sensor temperature signal, and directing the first heating element to an inhibited state based on determining the first-element pre-cooking threshold is reached.

3. The oven appliance of claim 2, wherein cooking operation further comprises activating the second heating element based on determining the first-element pre-cooking threshold is reached.

4. The oven appliance of claim 1, wherein the first fractional constant is greater than the second fractional constant.

5. The oven appliance of claim 1, wherein determining the first progress value comprises calculating a first-sensor variable based on the first-sensor temperature signal and a first-element pre-cooking threshold, and modifying the first-sensor variable using the first fractional constant.

6. The oven appliance of claim 5, wherein the cooking operation further comprises receiving a first preliminary signal from the first temperature sensor prior to receiving the first-sensor temperature signal, and wherein the first-sensor variable is further based on the first preliminary signal.

7. The oven appliance of claim 1, wherein the cooking operation further comprises directing a pre-cooking setting of the second heating element following directing the pre-cooking setting of the first heating element, and wherein determining the second progress value comprises calculating a second-sensor variable based on the second-sensor temperature signal and a second-element pre-cooking threshold, and modifying the second-sensor variable using the second fractional constant.

8. The oven appliance of claim 7, wherein cooking operation further comprises receiving a second preliminary signal from the second temperature sensor prior to receiving the second-sensor temperature signal, and wherein the second-sensor variable is further based on the second preliminary signal.

9. The oven appliance of claim 1, wherein the first heating element is a bottom heating element, and wherein the second heating element is a top heating element disposed above the bottom heating element.

10. The oven appliance of claim 1, wherein the first heating element is a top heating element, and wherein the second heating element is a bottom heating element disposed below the top heating element.

11. A method of operating an oven appliance comprising a plurality of chamber walls mounted within a cabinet and defining a cooking chamber, a first heating element mounted within the cooking chamber, and a second heating element mounted within the cooking chamber and spaced apart from the first heating element, the method comprising:

directing a pre-cooking setting of the first heating element;

receiving a first-sensor temperature signal from a first temperature sensor, receiving the first-sensor temperature signal occurring during the pre-cooking setting of the first heating element;

determining a first progress value based on the first-sensor temperature signal and a first fractional constant, the first fractional constant being a predetermined proportion of a pre-cooking phase;

receiving a second-sensor temperature signal from a second temperature sensor;

determining a second progress value based on the second-sensor temperature signal and a second fractional constant, the second fractional constant being a predetermined proportion of the pre-cooking phase; and directing display of a progress icon based on the first progress value and the second progress value.

12. The method of claim 11, the method further comprising:

determining a first-element pre-cooking threshold is reached prior to receiving the second-sensor temperature signal; and directing the first heating element to an inhibited state based on determining the first-element pre-cooking threshold is reached.

13. The method of claim 12, the method further comprising:

activating the second heating element based on determining the first-element pre-cooking threshold is reached.

14. The method of claim 11, wherein the first fractional constant is greater than the second fractional constant.

15. The method of claim 11, wherein determining the first progress value comprises calculating a first-sensor variable based on the first-sensor temperature signal and a first-element pre-cooking threshold, and modifying the first-sensor variable using the first fractional constant.

16. The method of claim 15, the method further comprising:

receiving a first preliminary signal from the first temperature sensor prior to receiving the first-sensor temperature signal, and wherein the first-sensor variable is further based on the first preliminary signal.

17. The method of claim 11, the method further comprising:

directing a pre-cooking setting of the second heating element following directing the pre-cooking setting of the first heating element, and wherein determining the second progress value comprises calculating a second-sensor variable based on the second-sensor temperature signal and a second-element pre-cooking threshold, and modifying the second-sensor variable using the second fractional constant.

18. The method of claim 17, the method further comprising:

receiving a second preliminary signal from the second temperature sensor prior to receiving the second-sensor temperature signal, wherein the second-sensor variable is further based on the second preliminary signal.

19. The method of claim 11, wherein the first heating element is a bottom heating element, and wherein the second heating element is a top heating element disposed above the bottom heating element.

20. The method of claim 11, wherein the first heating element is a top heating element, and wherein the second heating element is a bottom heating element disposed below the top heating element.

* * * * *